United States Patent [19]

Yamauchi et al.

[11] Patent Number: 4,722,385

[45] Date of Patent: Feb. 2, 1988

[54] DEFLATOR FOR USE IN INJECTION MOLDING MACHINE

[75] Inventors: Noriyoshi Yamauchi; Hitoshi Ishida; Kazuaki Kawai, all of Hiroshima, Japan

[73] Assignee: Ryobi Ltd., Japan

[21] Appl. No.: 26,317

[22] Filed: Mar. 16, 1987

[30] Foreign Application Priority Data

| | | | |
|---|---|---|---|
| Mar. 14, 1986 | [JP] | Japan | 61-57680 |
| Mar. 20, 1986 | [JP] | Japan | 61-41564[U] |
| May 14, 1986 | [JP] | Japan | 61-111332 |
| May 16, 1986 | [JP] | Japan | 61-74146[U] |
| May 19, 1986 | [JP] | Japan | 61-75444[U] |

[51] Int. Cl.[4] ..... B22D 17/20

[52] U.S. Cl. ..... 164/305; 164/410; 425/420; 425/812

[58] Field of Search ..... 164/305, 410, 312, 113, 164/253; 425/420, 812

[56] References Cited

U.S. PATENT DOCUMENTS 4,489,771 12/1984 Takeshima et al. ..... 164/305

*Primary Examiner*—Kuang Y. Lin

*Attorney, Agent, or Firm*—Sughrue, Mion, Zinn, Macpeak, and Seas

[57] ABSTRACT

A deflator for injection molding in a cavity. Two exhaust passages connect the cavity to a detection valve and an exhaust valve, which is being pumped. The exhaust passages are arranged so that the molten metal reaches the detection valve before the exhaust valve. Closing of the detection valve triggers the pneumatic closing of the exhaust valve. Also included in the invention is a bounce reduction means for the exhaust valve and a rockable connection for approaching the deflator to the mold.

15 Claims, 26 Drawing Figures

DEFLATOR FOR USE IN INJECTION MOLDING MACHINE

BACKGROUND OF THE INVENTION

Field of the Invention

The present invention relates to an apparatus incorporated in a die-casting machine, an injection molding machine or the like for deflating the cavity of a metal mold during an injection molding operation.

The present invention also relates to a mechanism for preventing the rebounding of an exhaust valve of a deflator.

BACKGROUND OF THE INVENTION

If a gas remains in the cavity of a metal mold during the injection molding operation of an injection molding machine or the like, the gas may cause formation of blowholes in a product. It is therefore necessary to expel the gas from the mold by the use of a deflator.

Two types of the above-described deflator have heretofore been well known; one is the type that uses an overflow or an air vent formed in the metal mold and the other is the type disclosed in Japanese Patent Laid-Open No. 112646/1983.

The former type cannot achieve satisfactory deflation, leading to the problem that blowholes are formed in a molded product.

The latter apparatus, as shown in FIG. 1, has a construction in which a valve a is forced downwardly by a spring e and is held in an opened position by steel balls i and springs j. With the valve a opened, the air in a cavity b is passed from a bypass exhaust bore c through an exhaust port d and is expelled by a vacuum pump (not shown). The valve a is pushed up to close the exhaust port d only when molten metal rather than air contacts with a valve head a'.

The above-described construction, however, actually requires gaps g to exist between both sides of the valve head a' and corresponding cemented boards f in order that the valve a will be smoothly moved upwardly by the collision of molten metal against the valve head a'. As a result, in practice, the above-described gaps g are formed. However, if such gaps g exist, the molten metal at the time of injection may flow from the exhaust port d into a valve body h earlier through the aforesaid gaps g than through the bypass exhaust bore c. Or, if molten metal sticks to a tapered surface a'' of the valve head a', the valve action becomes unstable and molten metal flows into the valve body h. Also, a closing force acts on the valve because of the upwardly urging spring and the pressure difference brought about by the exhaust. This closing force requires a holding force. Therefore, although the valve is constructed so that it can be adjusted by the steel balls i and the spring j, there are problems as mentioned below. First, if the holding force is greater than the impact of molten metal plus the force of the spring e, the valve does not work. That is, the exhaust port is not closed. Secondly, on the other hand, if holding force is less than the pressure difference provided by the exhaust plus the force of the spring e, the valve prematurely closes prior to exhaust.

For these reasons, adjustment is time-consuming, and the valve action becomes unstable if there are fluctuations in the level of impact of molten metal.

Furthermore, the molten metal approaches the valve head a' along a passageway that extends in parallel to the face of the valve head a'. As a result, the force of the molten metal on the valve head a' is primarily hydrostatic rather than dynamic or inertial.

Japanese Patent Publication No. 463787/1983 discloses a type of the metal mold provided with a deflator for releasing gas during injection. The deflator has an exhaust valve disposed in an exhaust passage led from the cavity of the metal mold and effects injection in a valve-opened state. At that moment that the low-mass gas in the cavity has substantially been expelled through the aforesaid exhaust passage, the inertial force of injected molten metal of a high mass which has advanced from inside the cavity is made to act directly on the exhaust valve, thereby causing the exhaust valve to be moved to shut off the exhaust passage. Thus, the flow of the injected molten metal from this exhaust passage is prevented, so that gas is released during injection.

The above described deflator is slidably fitted into the movable and fixed cemented boards of the metal mold, and furthermore slidably joined together by a hydraulic cylinder in synchronization with an injection molding cycle. However, since the metal mold comprises the deflator and the rod of the hydraulic cylinder which are directly coupled with each other, alignment during assembly is difficult. Accordingly, it is impossible to control alignment after assembly so that a large sliding resistance may occur between the deflator and the movable and fixed cemented plates.

Therefore, if the aligned between the deflator and the cemented board is imperfect, a scratch is formed on a slide surface and thus an extra force acts on the deflator. This causes deformation of the deflator and precludes smooth operation of the exhaust valve, thereby preventing achievement of the initial object or leading to the problem that, if the deflator is inclined and inserted into the cemented board, a valve for expelling gas comes into contact with the cemented board, causing an inoperative state.

Holder in U.S. Pat. No. 4,239,080 discloses a deflator having parallel venting valve and actuating valve with a mechanical linkage therebetween. Other pertinent prior art includes Japanese First Publication No. 60-82262.

SUMMARY OF THE INVENTION

The present invention aims at solving the above-described problems.

The invention can be summarized as a deflator of the type in which a detection-line valve and an exhaust-line valve are respectively disposed in exhaust passage led from the cavity of a metal mold. The detection-line valve is arranged to perform a closing operation by virtue of the inertial force of the molten metal which has been injected. Both the valve communicate with each other. The exhaust-line valve is caused to close with a time lag by virtue of the air supplied from an air source by the closing operation of the detection-line valve, thereby enabling smooth operation and positive deflation.

Specifically, the present invention provides a deflator in which a detection-line valve and an exhaust-line valve are respectively disposed in exhaust passages led from a cavity of a metal mold. Molten metal filled into the cavity of the mold reaches the detection-line valve before it reaches the exhaust-line valve.

The detection-line valve is arranged to close by virtue of the inertial force of the molten metal which has been injected. The detection-line valve is a cross-coupling valve means capable of opening against the force of a spring compressed by the closing operation of the detection-line valve. The detection-line valve and the exhaust-line valve communicate with each other so that the exhaust-line valve is capable of closing by virtue of the air supplied from an air source through the cross-coupling valve.

The invention is characterized in that the exhaust passage on the side of the exhaust-line valve is formed in a stepped manner such that the flow of injected molten mold may lag behind the flow through the exhaust passage on the side of the detection-side valve. Thereby it is possible to prevent the injected molten metal from flowing into the exhaust-line valve while the exhaust-line valve is being closed after the closing operation of the detection-line valve. This construction succeeds in solving the above-described problems of the prior art.

In another aspect of the invention, the detection-line valve is disposed for rotation through a desired angle owing to the inertial force of the molten metal which has been injected. A pneumatic valve is caused to slide by a spring force in linked relation to the rotation of a cam fixed to a valve rod thereby causing the exhaust-line valve to close by virtue of the air supplied from an air source. Thus the structure can be simplified because there is no necessity for a hydraulic system and yet positive deflation is enabled with a smooth action and without involving non-operation.

A third embodiment of the invention is characterized in that a changeover valve is integrally fixed to a detection valve which is inserted so that it can be held in a valve opening position by stoppers. the stopper are freely sliding along the axis of a valve bore in a detection valve body. They urge a steel ball by means of a spring. The changeover valve is capable of airtightly engaging with a valve seat of the detection valve body and with a valve bore of a valve holder fixed to the detection valve body. Air chambers are respectively provided along the peripheries of the changeover and detection valves. The one air chamber is connected to an air source so as to be capable of communicating with or being shut off from the air source by virtue of the closing or opening operation of the detection valve. The other air chamber is connected to an air chamber of the exhaust-line valve. This construction succeeds in solving important problems.

In another aspect of the invention, the deflator is mounted on a valve body holding plate slidably attached to a cemented board with a guide means interposed therebetween. The connecting metal member of a deflator and the rod of a hydraulic cylinder are movably coupled by a joint which has spherical surfaces butting each other and movably coupled together. This makes it easy to mount and align the deflator with respect to a metal mold, and it is possible to reduce the sliding resistance of the deflator concerned so that the operation of an exhaust valve is positively and smoothly carried out.

More specifically, this other aspect of the present invention provides a construction in which a valve body holding plate is mounted on a movable cemented plate with a guide means interposed therebetween. The deflator is mounted on the valve body holding plate for sliding movement with respect to a metal mold. Respective joints of the connecting metal member of the deflator and the rod of the hydraulic cylinder are screwed into each other on the same axial line. A casing comprising separately formed members jointed as a unit by making the spherical surfaces of the joints but each other, whereby the deflator and the hydraulic cylinder rod are coupled by movably holding the joints in a groove of the casing. By so doing, the present invention succeeds in solving the above-described problems.

In a still further aspect of the present invention, an absorption plate is attached at a suitable position of an exhaust valve stem in such a manner as to be moved upward by the exhaust valve during the closing operation of the exhaust valve, whereby the aforesaid absorption plate absorbs the kinetic energy of the exhaust valve during its closing operation. The object of this aspect of the present invention is to eliminate the rebounding of the exhaust valve using such absorption, thereby enabling a reduction in the operation time of the exhaust valve and the positive closing of the exhaust port.

Specifically, this aspect of the present invention provides a mechanism for preventing the rebounding of an exhaust-line valve of a deflector in which an exhaust valve is being caused to close either directly by the inertial force of molten metal or indirectly by air through a detection-line valve which is closed by the inertial force. This aspect is characterized in that an exhaust port is attached to an exhaust valve body capable of sliding so as to open and close the exhaust port. An absorption plate is attached at a desired position of the exhaust valve in such a manner that the exhaust valve can be moved upwardly by collision during its closing operation. The absorption plate is inserted into an absorption casing fixed coaxially to the exhaust valve body.

DETAILED DESCRIPTION OF THE PREFERRED EMBODIMENTS First Embodiment

Figure 1:
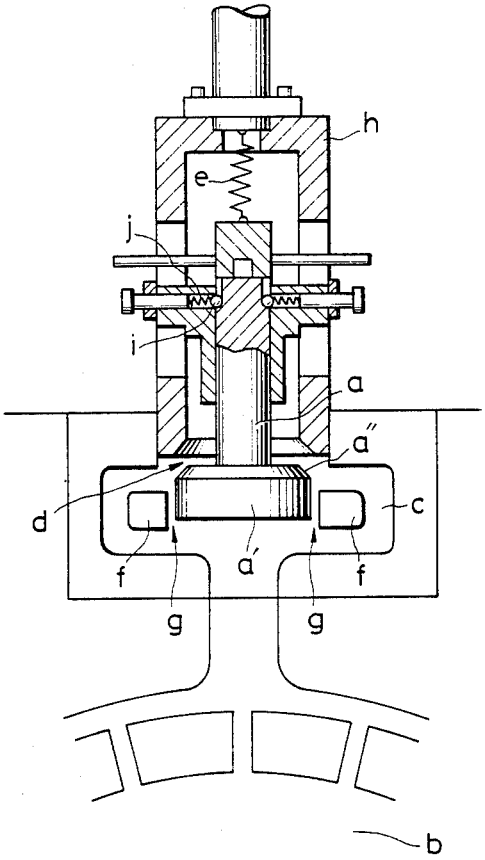
FIG. 1 PRIOR ART
FIG. 1 is a longitudinally sectional, front elevational view of a deflator of the prior art.
Figure 2:
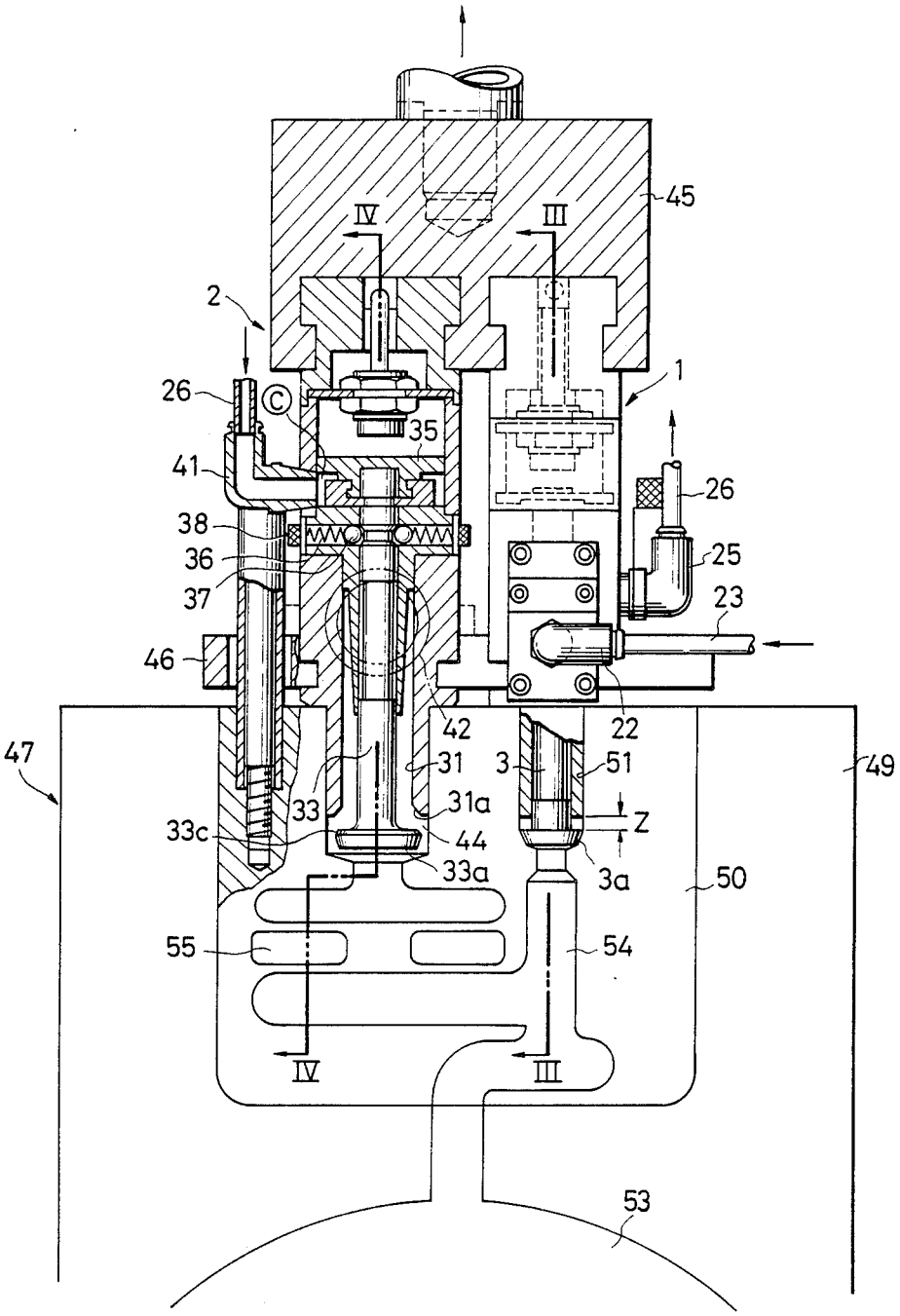
FIG. 2 is a partially sectional, front elevational view of one embodiment of a deflator for use in an injection molding machine in accordance with the present invention.

A first specific embodiment of a deflator for use in an injection molding machine in accordance with the present invention will be described below in detail with reference to the drawings of FIGS. 2 through 7. As shown in FIG. 2, a detection-line valve 1 and an exhaust-line valve 2 are disposed side by side.

Figure 3:
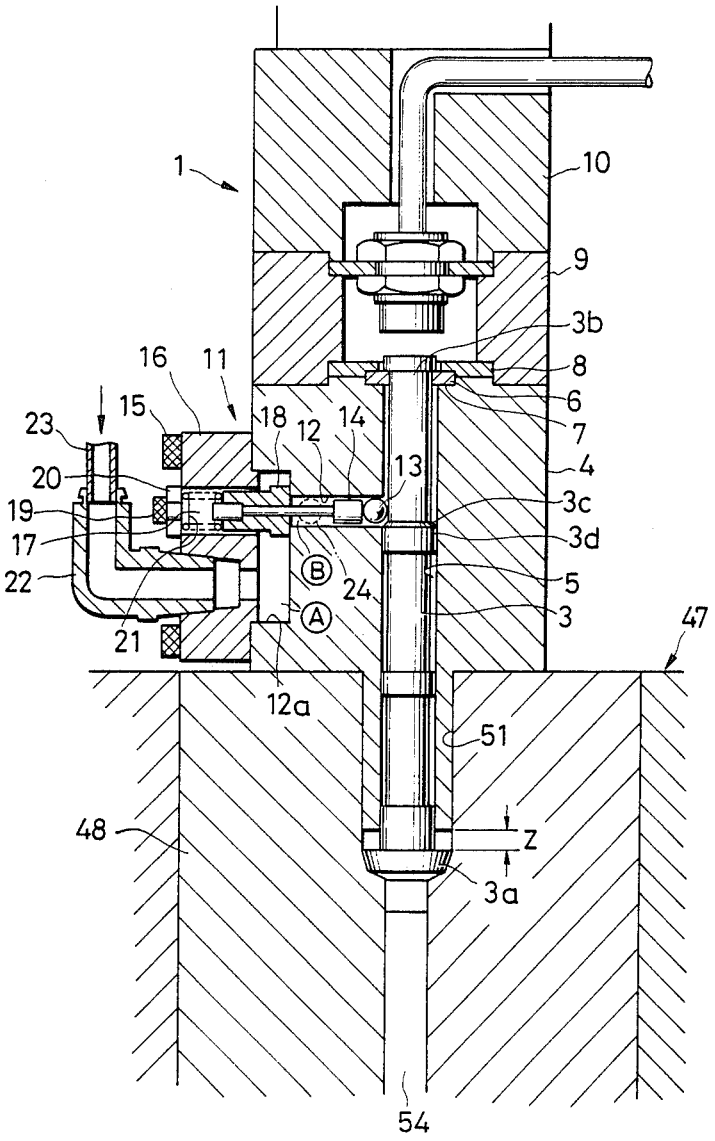
FIGS. 3 and 4 are longitudinally sectional, side elevational views respectively taken long line II—II and line IV—IV of FIG. 1.

The detection-line valve 1 is formed in the following manner, as shown in either FIG. 3 or 5. A detection valve 3 having a valve head 3*a* at the lower end is slidably inserted into a valve bore 5 which is vertically formed through the length of a detection valve body 4. A half fitting 6 prevents the detection valve 3 from coming off in the downward direction. The half fitting 6 is disposed at a stepped portion 3*b* of one end of the detection valve 3 and is held by a pressure ring 8 so that the half fitting 6 is engaged with a counter bore 7 of the detection valve body 4.

The detection valve body 4, a middle detection spacer 9 and an upper detection spacer 10 are fastened together by bolts (not shown). The pressure ring 8 is clamped between the detection valve body 4 and middle detection spacer 9.

The detection valve body 4 is also provided with a cross-coupling valve 11 on one side thereof. The cross-coupling valve is formed as follows in such a manner as to be caused to open by an upwardly facing portion 3*c* which is formed on the middle of the detection valve 3. The opening of the cross-coupling valve 11 occurs during the closing operation of the detection valve 3.

A transverse bore 12 is formed on one side of the detection valve body 4 so as to communicate with the vertical valve bore 5. A steel ball 13 and a connecting rod 14 are slidably inserted into the transverse bore 12 in this order from the inner side thereof. The enlarged outer end of the transverse bore 12 forms an enlarged hole 12*a* and a detection holder 16 is fixed to the detection valve body 4 by bolts 15 to thereby cover the opening of the enlarged hole 12*a*. A detection piston 18 bolted to the connecting rod 14 is slidably inserted into a bore 17 which is formed along the coaxial line of the transverse bore 12. The detection piston 18 is urged to the right in FIGS. 3 and 5 by a compression spring 21 interposed between the piston 18 and a pressure plate 20 which is fixed to the opening of the bore 17 by a bolt 19 so as to enclose the bore 17. When the detection valve 3 is in an opened (downward) state, the detection piston 18, as shown in FIG. 3, abuts against the bottom (right) surface of the enlarged hole 12 to close off the transverse bore 12. Simultaneously, the steel ball 13 abuts against the stepped portion 3*c* which is formed by providing a large-diameter portion 3*d* on the detection valve 3. In consequence, the detection valve 3 is held in the open position and in this state the enlarged hole 12*a* and the transverse bore 12 respectively form chambers A and B.

A pipe elbow 22 is airtightly screwed into the detection holder 16 and the elbow 22 is connected to an air source (not shown) such as a compressor by a hose 23. The air source supplying air to the chamber A in the enlarged hole 12*a*.

A bore 24 is connected at a right angle with the transverse bore 12, specifically with the chamber B. This bore 24 is airtightly connected to a pipe elbow 25, shown in FIG. 2, and the elbow 25 communicates with a later-described portion of the exhaust-line valve 2 through a hose 26.

Figure 4:
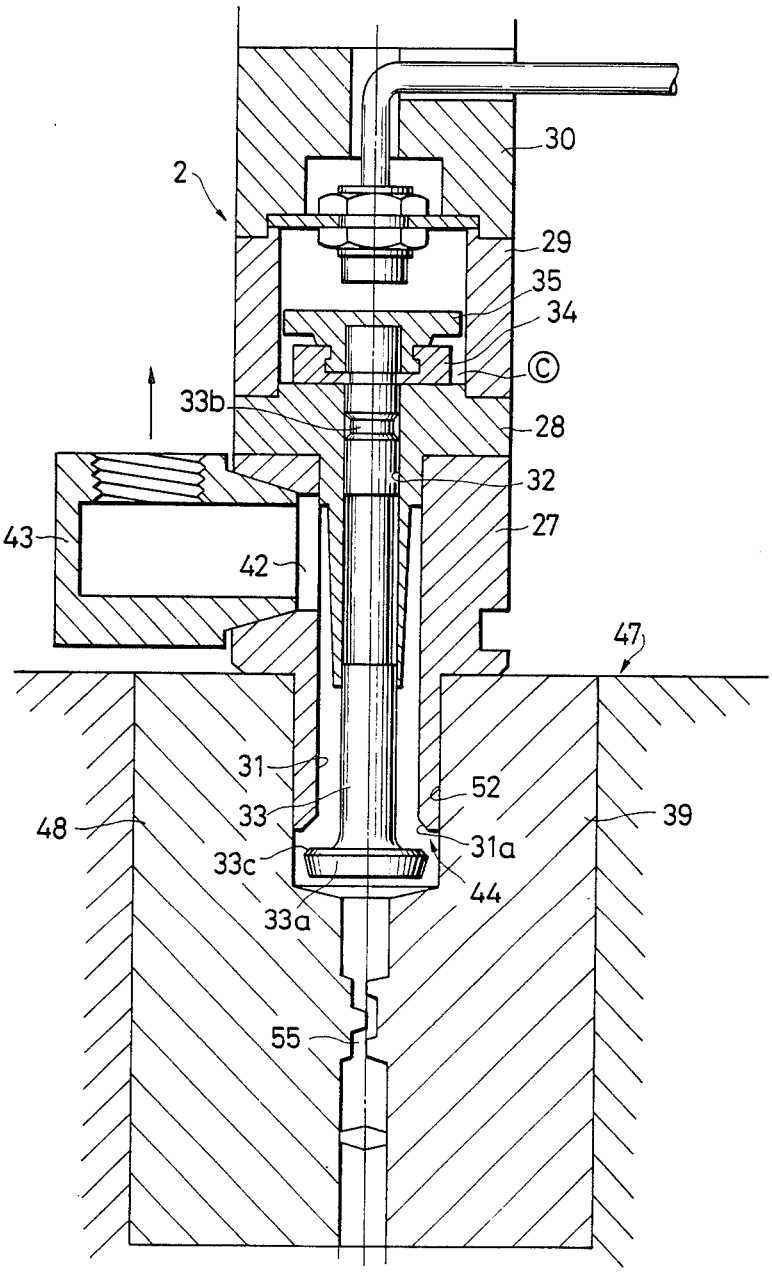
Figure 6:
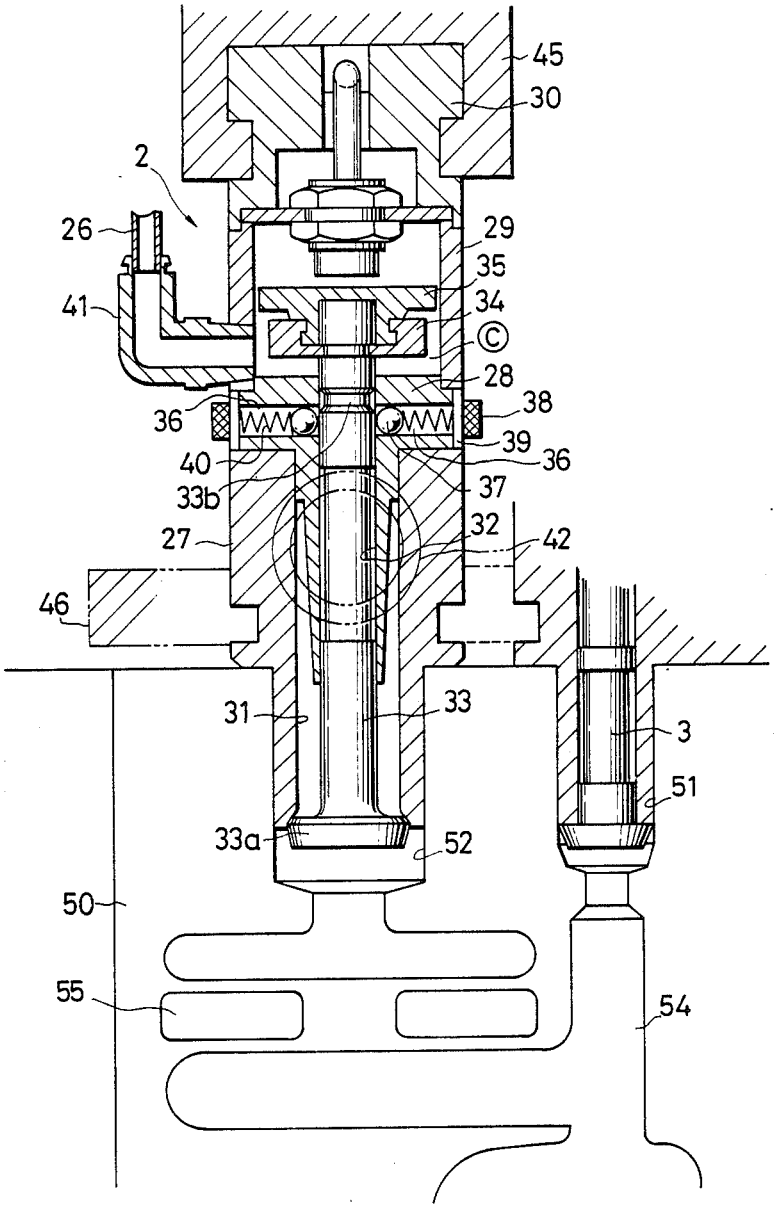
FIG. 6 is a longitudinally sectional, side elevational view of the closed state of the exhaust-line valve incorporated in the same embodiment.

The exhaust-line valve 2 is formed as follows, as shown in either FIG. 4 or 6. An exhaust valve body 27, an exhaust valve guide 28, an exhaust spacer 29 and an exhaust base 30 are coaxially fixed together by bolts (not shown). An exhaust valve 33 having a valve head 33*a* at the lower end is axially slidably inserted into an exhaust bore 31 of the exhaust valve body 27 and into a valve bore 32 of the exhaust valve guide 28. The valve head 33*a* of the exhaust valve 33 is further capable of opening and closing the exhaust bore 31. A piston fastener 34 and an exhaust piston 35 for moving the exhaust valve 33 upwardly are fixed to the upper end of the exhaust valve 33.

The piston fastener 34 consists of half parts and the exhaust valve 33 and the exhaust piston 35 are held and fastened together bolts (not shown).

Figure 7:
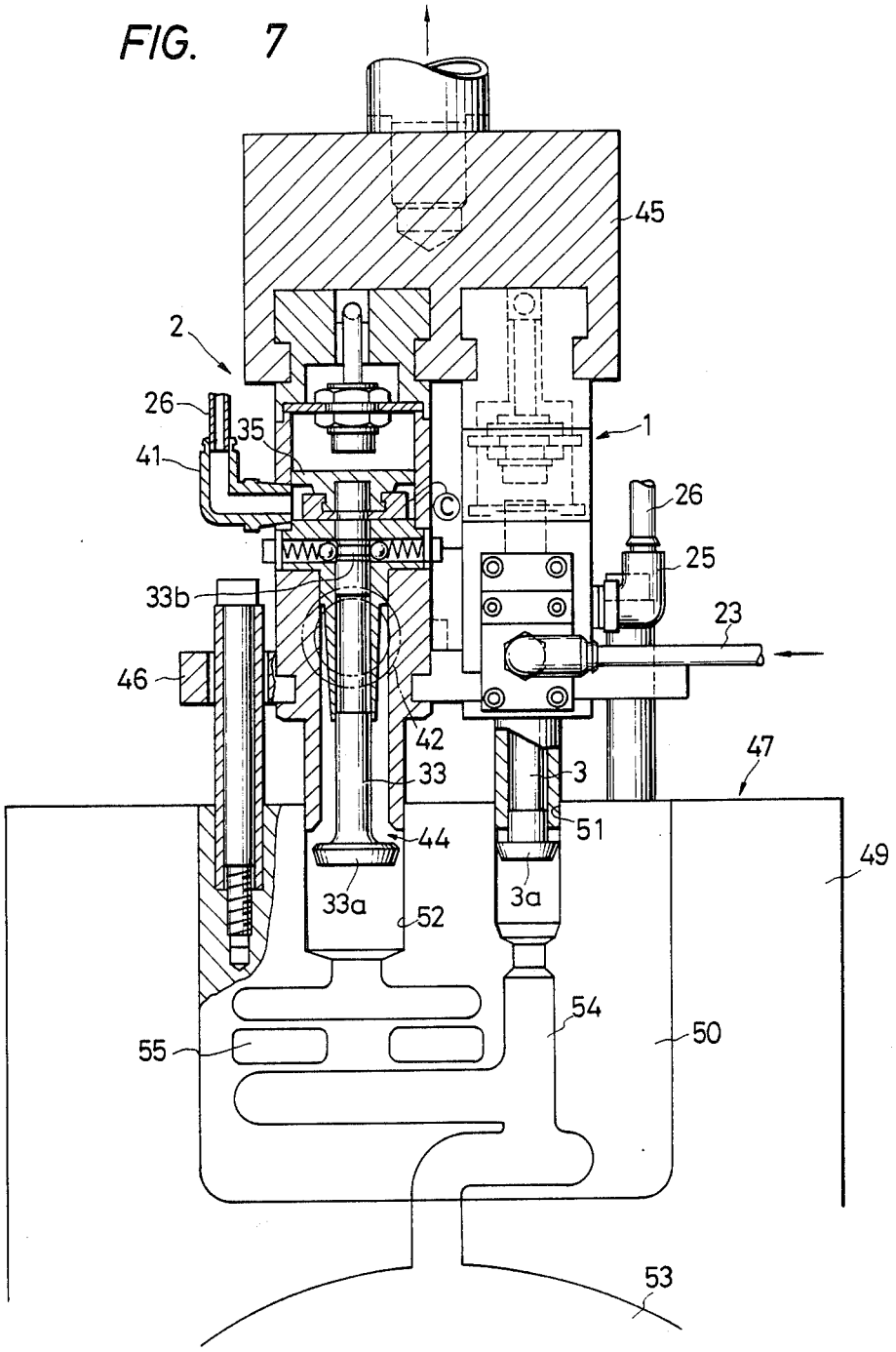
FIG. 7 is a partially sectional, front elevational view of the same embodiment which is moved to its upward position.

Also, an annular groove 33*b* is formed along the periphery of a portion of the exhaust valve 33 located with in the exhaust valve guide 28. Two transverse bores 36, shown in FIG. 6, are formed in opposite directions through the exhaust valve guide 28 and are connected with the vertical valve bore 32. Steel balls 37 are rotatably and slidably fitted into the respective transverse bores 36. The steel balls 37 are urged toward the exhaust valve 33 by compression springs 40 which are interposed between the steel balls 37 and pressure plates 39 fixed to the openings of the transverse bores 36 by bolts 38. Thus, the steel balls 37 are fittable into the annular groove 33*b* of the exhaust value 33 so as to be brought into or out of engagement with the groove 33*b*, thereby holding the exhaust valve 33 at an open (down) position as shown in FIGS. 4 and 7.

Also, a pipe elbow 41 (FIG. 6) is airtightly screwed into one side of the exhaust spacer 29. The chamber B in the detection-line value 1 is connected to a chamber C formed in the exhaust spacer 29 by connecting the hose 26 between the detection-line valve 1 and the elbow 41. The exhaust piston 35 and the piston fastener 34 are formed in a shape such that can be pushed up by the air supplied to the chamber C through the pipe elbow 41.

An exhaust port 42 (FIG. 4) is formed in one side of the exhaust valve body 27. The exhaust port 42 is connected through an exhaust pipe 43 to a vacuum pump (not shown) for discharging gas toward the exterior. The timing of evacuation of the vacuum pump is controlled by a limit switch and a solenoid valve although neither is shown.

A tapered surface 33*c* is formed on the upper edge of opposite sides of a valve head 33*a* of the exhaust valve 33 while a tapered surface 31*a* is formed on the lower edge of opposite sides of a exhaust bore 31 in the exhaust valve body 27. An exhaust port 44 is airtightly closed by the contact between the tapered surfaces 33*c* and 31*a*.

In addition, as shown in FIG. 2, both the detection-line valve 1 and the exhaust-line valve 2 are detachably mounted as a unit at the top on a connection member 45 and at the bottom on a support plate 46. The respective lower ends of the bodies 4 and 27 of the valves 1 and 2 are inserted vertically, slidably and airtightly into insertion grooves 51 and 52. The insertion grooves 51 and 52 are formed in a cemented board 50 disposed at a separation surface portion between, as shown in FIG. 4, a fixed die 48 and a movable die 49 which constitute a metal mold 47. The lower end is arranged to move up and down by a fixed distance by a hydraulic cylinder (not shown).

Exhaust passages 54 and 55 are led from a metal charging cavity 53 formed in the separation surface portion of the metal mold 47. The respective exhaust passages 54 and 55 are connected with the insertion groove 51 and 52. Thus, the exhaust passages 54 and 55 respectively communicate with the detection-line valve 1 and the exhaust-line valve 2. However, the exhaust passage 54 on the side of the detection-line valve 1 is arranged in such a manner that, when the molten metal charged into the cavity 53 advances and collides against the valve head 3*a*, the detection valve 3 is moved upwardly to thereby be closed. In order to impart a time delay (e.g. about 5/1000 sec.) to the arrival of the molten metal at the exhaust-lien valve 2 in relation to the closing operation of the detection-line valve 1, the exhaust passage 55 on the side of the exhaust-line valve 2 is formed, for example, in a baffled shape, as shown in FIG. 4 thereby obtaining an increase in its surface area without changing its cross-sectional area. Accordingly, while the exhaust-line valve 2 is performing a closing operation, no molten metal reaches the exhaust-line valve 2, that is, the molten metal does not easily flow into the exhaust-line valve 2.

The operation of the present invention will now be described. When the molten metal charged into the cavity 53 reaches the exhaust passage 54 and collides against the valve head 3*a*, the detection valve 3 is caused to move upwardly by a distance Z as shown in FIG. 5 by the impact or pressure, so that the detection-line valve 1 is caused to close.

At this time, even at the time of low-speed injection, the molten metal advances along the exhaust passage 54 toward the detection-line valve 1 without flowing into the other exhaust passage 55 for the exhaust-line 2. Therefore, only gas is passed through the exhaust passage 55 into the exhaust-line valve 2 and is discharged through the exhaust port 42 by the vacuum pump.

Figure 5:
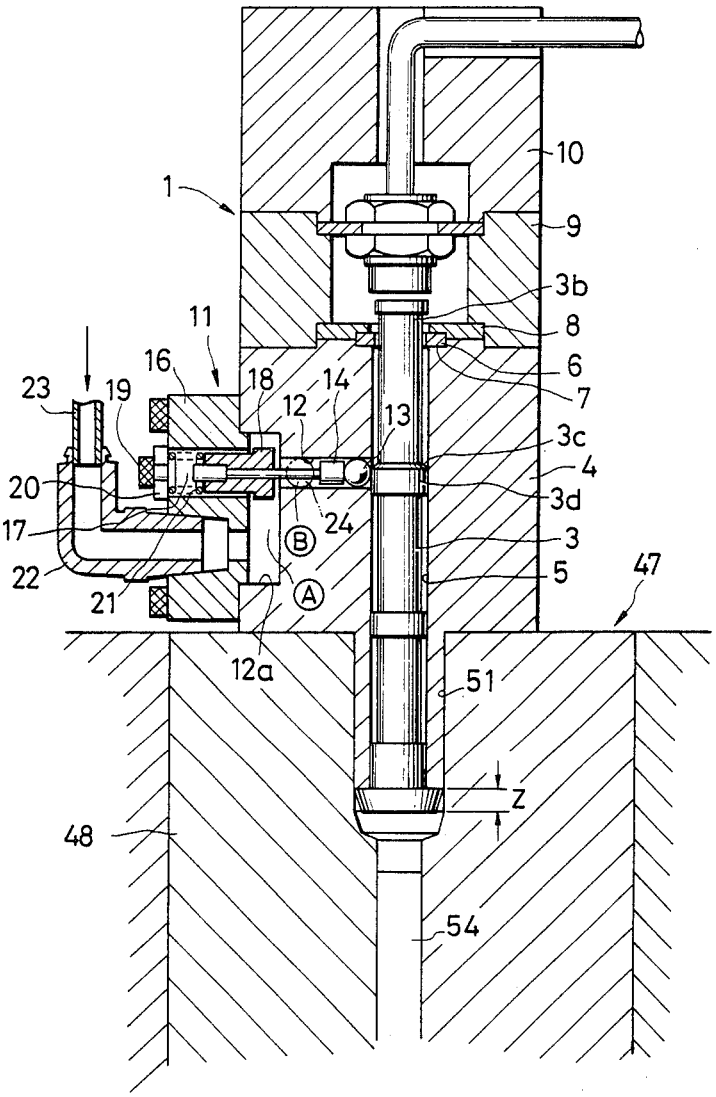
FIG. 5 is a longitudinally sectional, side elevational view of the closed state of the detection-line valve incorporated in the same embodiment.

When, as shown in FIG. 5, the detection-line valve 1 is closed, the steel balls 13 are pressed by the stepped portion 3*c* of the detection valve 3, then the steel balls 13, the connecting rods 14 and the detection piston 18 are moved leftwardly against the spring force. This movement opens a path between the chambers A and B. Thereby, the air supplied to the chamber A from the air source is passed through the bore 24, the transverse pipe elbow 25 and the hose 26 ,and then into the chamber C of the exhaust valve 2. The pressure of this air pushes the exhaust piston 35 and the piston fastener 34 in the upward direction.

Accordingly, the upward movement of the exhaust valve 33 causes the valve head 33*a* to close the exhaust port 44, and thus the exhaust valve 2 is closed.

The molten metal passes through the exhaust passage 55 and reaches the exhaust-line valve 2, but the exhaust valve 2 has already been closed, so that no molten metal flows into the valve through the exhaust port 44.

When the molten metal has so lifted, a forging machine (not shown) is actuated to open the mold. Then, a hydraulic cylinder (not shown) acts to move the deflator upwardly as shown in FIG. 7. Simultaneously, the detection valve 3 and the exhaust valve 33 of the detection-line and exhaust-line valves 1 and 2 of the deflator which has moved upwardly are respectively returned to their opened states by virtue of the contraction force when a molten oil solidifies.

Subsequently, after a normal injection molding cycle (removal of a molded product—mold closing) has be completed, the deflator is moved downwardly by a hydraulic cylinder and assumes the stand-by position for the succeeding molding operation.

The deflator for use in an injection molding machine of the present invention is constructed as described above. The inertial force of the molten metal which has been injected causes the detection-line valve 1 to close without causing the exhaust valve 2 to immediately close. This closing operation opens the cross-coupling valve 11, and thus the exhaust-line valve 2 is caused to close by the force of the air supplied from the air source. The exhaust passage 54 on the side of the detection-line valve 1 led from the cavity 53 is formed so that molten metal can directly advance into the detection-line valve 1. On the other hand, the exhaust passage 55 on the side of the detection-line valve 1 led from the cavity 53 is formed in a stepped or baffled shape so as to increase its surface area without changing an exhaust cross sectional area, to change the direction of flow of the molten metal, and/or to increase the contact resistance of the molten metal and the fluid resistance resulting from the cooling effects of the same, so that molten metal does not easily flow in the exhaust passage 55. When molten metal has passed through the exhaust passage 55 and reaches the exhaust-line valve 2, the exhaust-line valve 2 has already been closed, so that no molten metal flows into the exhaust-line valve 2. It is therefore possible to solve various operational problems which might be caused by the flow of molten metal into the valve as in the conventional example. This provides the advantage in that the opening and closing of the valve can be smoothly performed to ensure smooth and positive deflation.

Second Embodiment

In a second embodiment of the invention, the detection-line valve is provided with a cam at one end of a valve rod so as to allow rotation of the detection-lin valve through a desired angle by the inertial force of a molten metal which has been injected. The detection-line valve is capable of being reversed and reset after release of the mold by means of a piston using air as a drive source. The exhaust valve has a chamber disposed between an exhaust valve guide into which the valve rod is slidably inserted so as to freely open and close an exhaust hole. A piston is provided at one end of the valve rod. The chamber in the exhaust valve is connected with an air supply bore in a valve body and causes the valve rod to close by means of air supplied through the air supply bore. A pneumatic valve is disposed in a chamber formed in the valve body and enabling communication between the air supply bore and the chamber. This second embodiment is characterized in that a pneumatic valve is reciprocatively slidable in interlocked relation to the rotation on reverse reset motion of the detection valve. A spring is inserted into the pneumatic valve in such a manner so that the pneumatic valve reciprocally slides in interlocked relation to the rotation or reverse reset motion of the detection valve. The pnuematic valve forms and shuts off the connection between the chambers. The force of the spring acts to hold one end of the pneumatic valve in contact with the cam.

The second embodiment of the present invention will be described in detail below with reference to the accompanying drawings of FIGS. 8 to 13.

Figure 8:
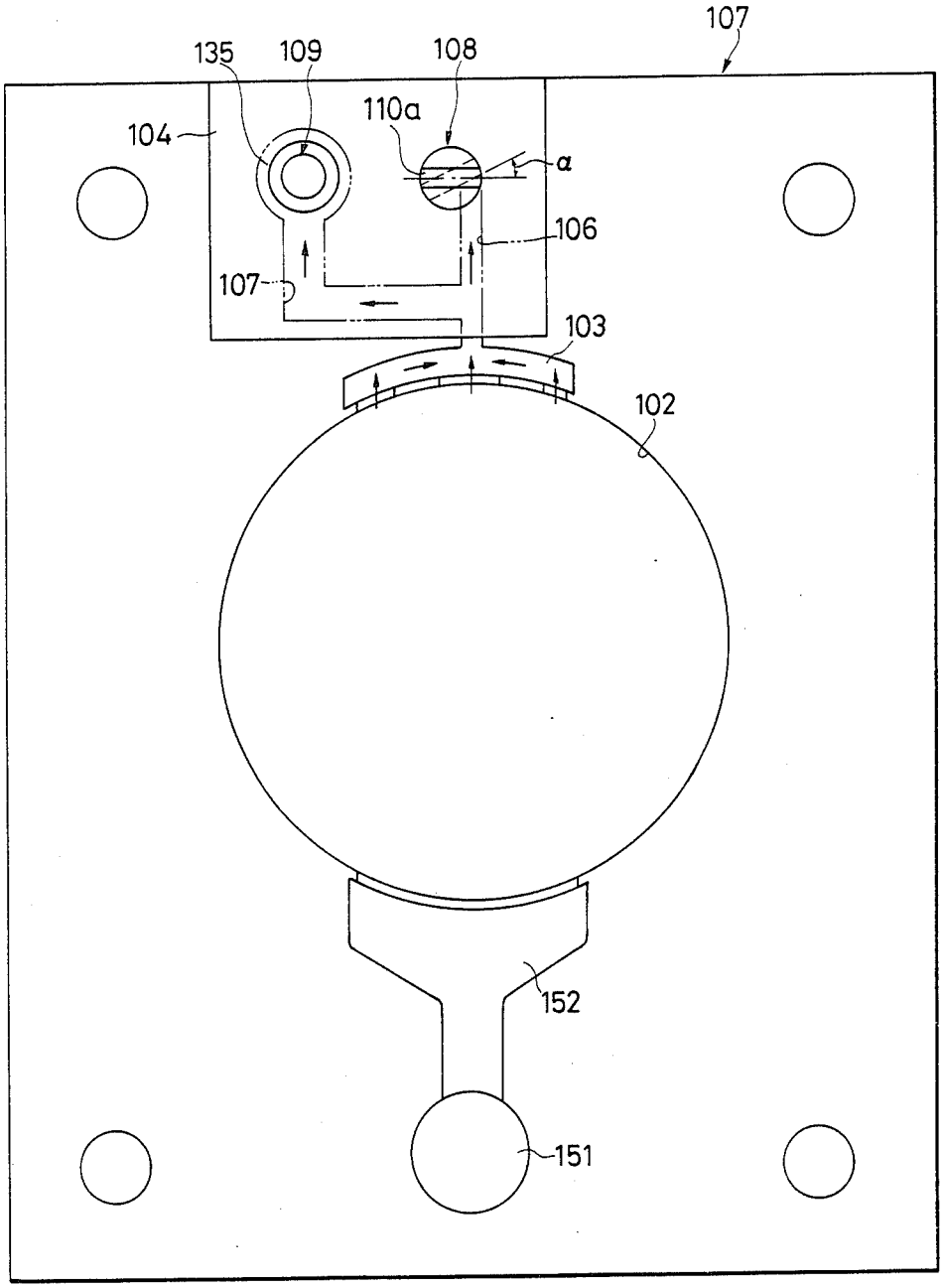
FIG. 8 is a front elevational view of an apparatus of a second embodiment of the present invention attached to a metal mold.

As shown in FIG. 8 a detection passage 106 and an exhaust passage 107 are disposed on a cemented board 104 to communicate with an exhaust passage 103 which is led from a cvity 102 of a metal mold 101.

Both the detection and exhaust passage 106 and 107 are formed to allow the molten metal filled into the cavity 102 to reach them with a time difference between the two. The detection passage 106 which the molten metal reaches earlier is provided with a detection-line valve 108 while an exhaust-line valve 109 is disposed in the exhaust passage 107 which the molten metal reaches later than when the molten metal which has reached the detection passage 106.

Figure 9:
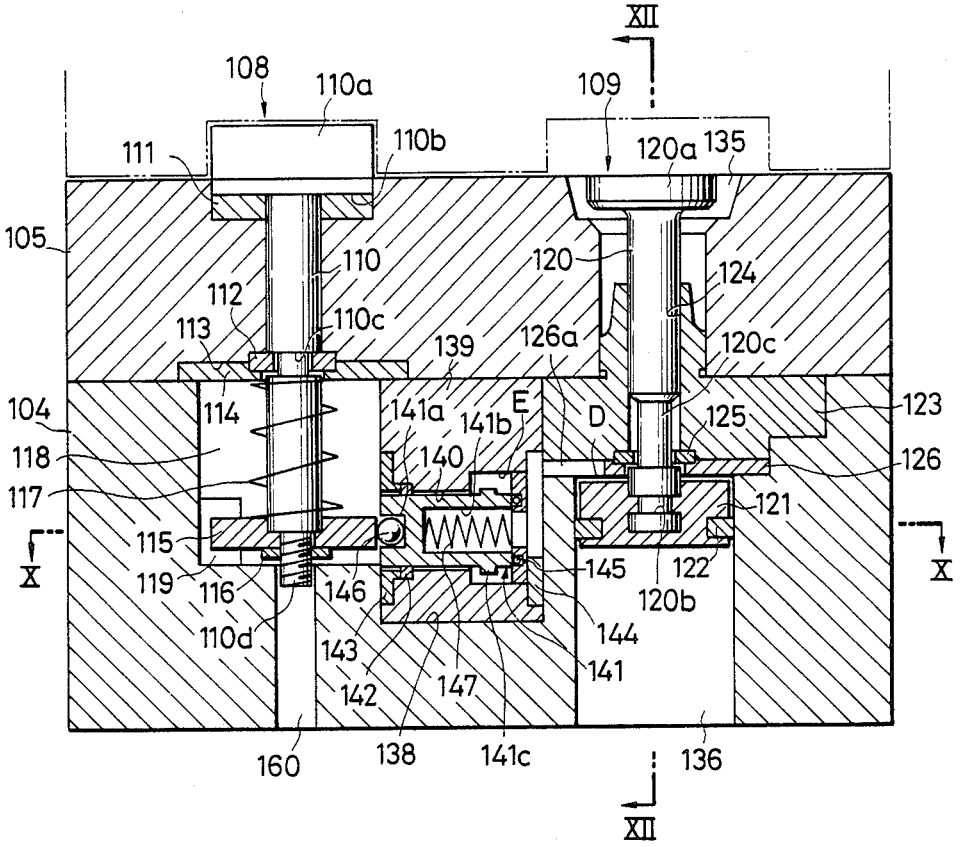
FIG. 9 is a longitudinally sectional, plan view of the second embodiment of a deflator for use in an injection molding machine in accordance with the present invention.

The detection-line valve 108 is constructed in the following manner, as shown in FIG. 9. A valve rod 110 having a head 110*a* is rotatably inserted between the front portion of a cemented board 105 and the rear portion of the cemented board 104. A metal valve face 111 having a small frictional resistance is interposed between a rotating slide surface 110*b* of the head 110*a* and the front portion of the cemented board 105 so as to allow smooth rotation of the valve rod 110. The head 110*a* is shaped, at least inpart, as a vane (see FIG. 8) extending across a diameter of the detection-line valve 108. The detection passage 106 faces a side surface of this vane at a position offset from the rotation axis of the detection-line valve 106. As a result, the inertial impact of the molten metal rotates the detection-line valve 106.

To prevent the valve rod 110 from coming off in the upward direction, a half mixture 112 is fitted onto an annular groove 110*c* formed in the periphery of a substantially intermediate portion of the valve rod 110. The fixture 112 is held by a pressure fitting 114 fitted into a counter bore 113 which is formed in the front portion of the cemented board 105.

A cam 115 for opening and closing a pneumatic valve to be later described is fixed to one end of the valve rod 110 by a nut 116 which is screwed onto a threaded portion 110*d* of the same end. The threaded portion 110*d* of the valve rod 110 extends partially into a bore 160. The cam 115 is shown in cross-section in FIGS. 10 and 11.

The head 110*a* of the valve rod 110 is formed intimately against the metal valve face 111 by fitting a compression spring 117 on to the valve rod 110 with opposite ends of the spring 117 abutting against the pressure fitting 114 and the cam 115. The pressure fitting 113 is clamped between the front and rear portions of the cemented boards 105 and 104, respectively, and both the cemented board 104 and 105 are connected by one or more bolts (not shown).

On one side of a vertically illustrated bore 118 communicating in the direction of the valve head 110*a* with the previously described detection passage 106 and formed in the cemented board 104 there is disposed a stopper 119 (shown in cross-section in FIGS. 10 and 11) for controlling the rotational position of the valve rod 110. The stopper 119 is engagable with one end of the cam 115.

In contrast with the above detection-line valve 108, the exhaust-line valve 9 is constructed in the following manner. An annular groove 120*b* is externally formed at one end of a valve rod 120 having a head 120*a*. A half exhaust piston 121 is bolted to the annular groove 120*b*. The piston 121 is slidably fitted into a piston cylinder 136 which communicates with the previously described exhaust passage 107. A seal 122 for preventing air leakage is fitted onto a groove formed in the periphery of the exhaust piston 121.

The valve rod 120 is slidably inserted into a valve bore 124 formed through the length of an exhaust valve guide 123 of the valve rod 120. A half fixture 125 for preventing the valve rod 120 from among off is engaged with an annular groove 120*c* formed in the periphery of a substantially intermediate portion of the valve rod 120 with the half fixture 125 being held against the exhaust valve guide 123 by means of a pressure fitting 126. The vavle guide 123 and the pressure fitting 126 are clamped between the rear portion of the cemented board 104 and the front portion of the cemented board 115, the cemented boards 104 and 105 being bolted together.

Figure 11:
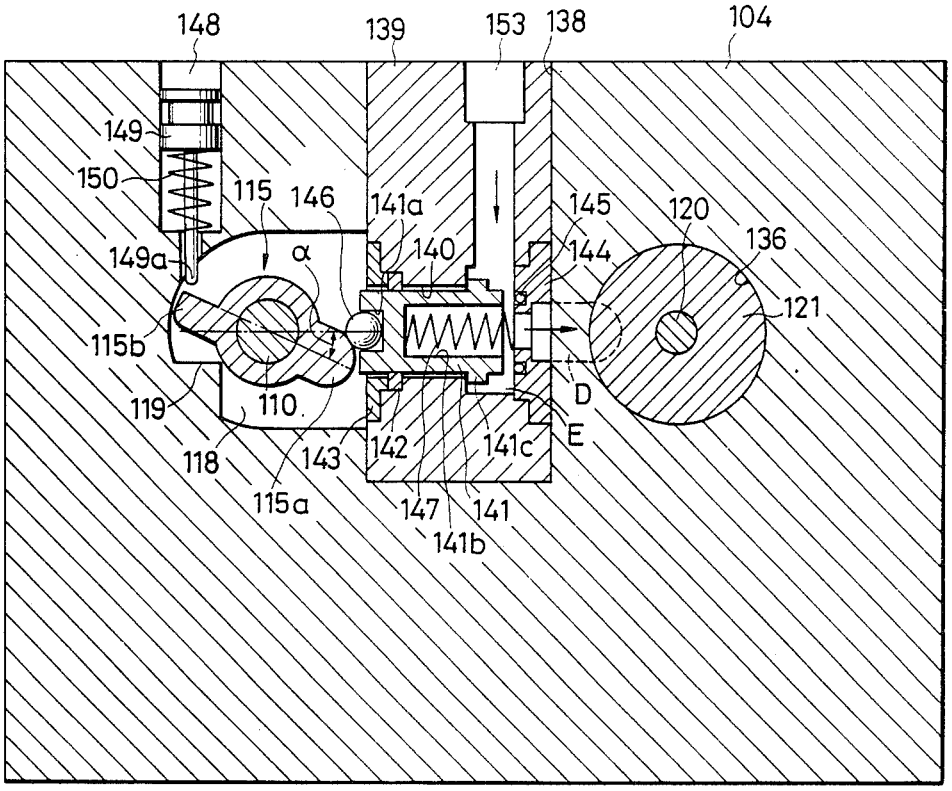
Figure 12:
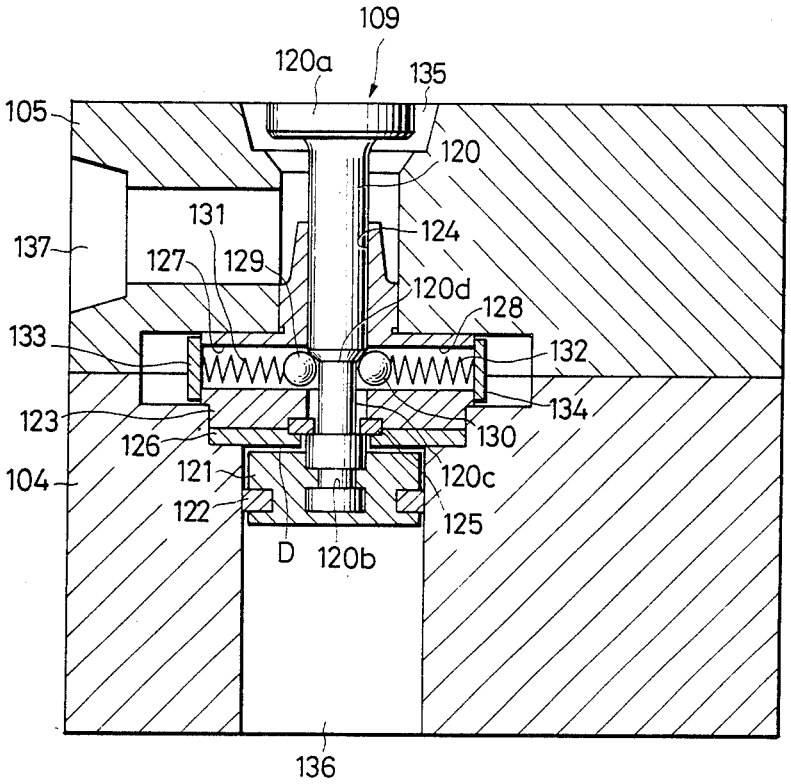
FIGS. 12 and 13 are sectional views taken along line XII—XII of FIG. 9 respectively showing the opened and closed states of the exhaust-line valve.
Figure 13:
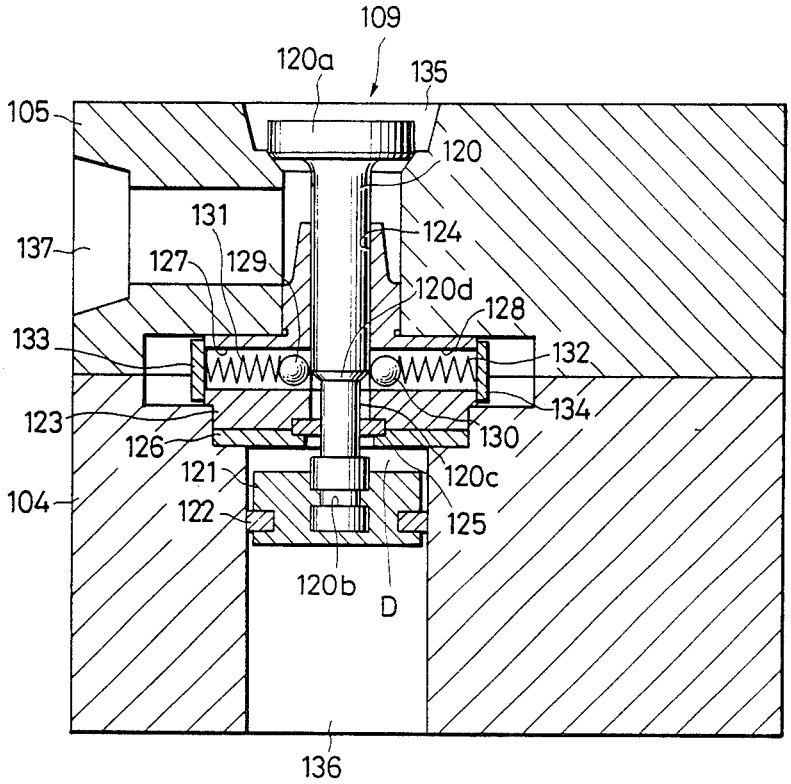

The exhaust valve guide 123 has two transverse holes 127 and 128, shown in FIGS. 12 and 13, symmetrical with each other and perpendicular to the valve bore 124. Steel balls 129 and 130 and compressing springs 131 and 132 are respectively inserted into the transverse bores 127 and 128. Fastening plates 133 and 134 are fixed to the exhaust valve guide 123 by bolts (not shown) so as to enclose the outer openings of the transverse bores 127 and 128, thereby imparting an initial compression to the compressing springs 131 and 132. Thus, as shown in FIG. 12, the steel balls 129 and 130 are engaged with the annular groove 120*c* of the valve rod 120 and this maintains the valve rod 120 in the state shown in FIG. 11 of opening an exhaust port 135, connected to the exhaust passage 107, in the cemented boards 105.

Also, a chamber D is defined between the exhaust piston 121 and the pressure fitting 126 in the piston cylinder 136. The chamber D communicates with a chamber in a valve body to be later described through a cutout 126*a* (FIG. 9) formed in a portion of the pressure fitting 126.

Also, a tapered surface 120*d* is formed at one end of the annular groove 120*c* of the valve rod 120. During a valve closing operation, the steel balls 29 and 30 are transferred from the annular groove 120*c*, as shown in FIG. 12, to the larger diameter surface of the valve rod 120, as shown in FIG. 13, when the valve is closed against the biasing force of the balls 129 and 130.

Also, an exhaust port 137 is formed in the upper portion of the cemented board 5 and communicates with the exhaust port 135 through the exhaust-line valve 109. The port 137 is connected to a vacuum pump by a hose (not shown) and the timing of evacuation performed by the vacuum pump is controlled by a limit switch and a solenoid valve (not shown).

In addition, as shown in FIG. 9, a recess 138 is formed in the rear portion of the cemented board 104 in an area between the detection-line valve 108 and the exhaust-line valve 109. A valve body 139, a shown also in FIGS. 10 and 11, by the recess 138 and is clamped between the cemented boards 104 and 105.

An elongated transverse valve bore 140 is formed in the valve body 139 in the direction between the detection-line and exhaust-line valves 108 and 109. A pneumatic valve 141 is slidably inserted into this valve bore 140.

The bore 118 below the detection-line valve 108 communicates with one end of the transverse valve bore 40. A seal 142 for preventing air leakage is fixed to the valve body 139 at the left end while a chamber E is formed at the right end of the transverse valve bore 140. A path fitting 144 forming the communication between the chamber E and the previously described chamber D is fixed to the valve body 139. A seal 145 for preventing air leakage is attached to the inner surface of the path fitting 144 in such a manner as to allow intimate contact with the rear end of the pneumatic valve 141.

Also, a recess 141*a* is formed in the front (left) end of the pneumatic valve 141 and a steel ball 146 is fitted into the recess 141*a* with a small tolerance. The steel ball 146 enables the front end of the pneumatic valve 141 to smoothly abut against the cam 115 of the detection-line valve 108.

Figure 10:
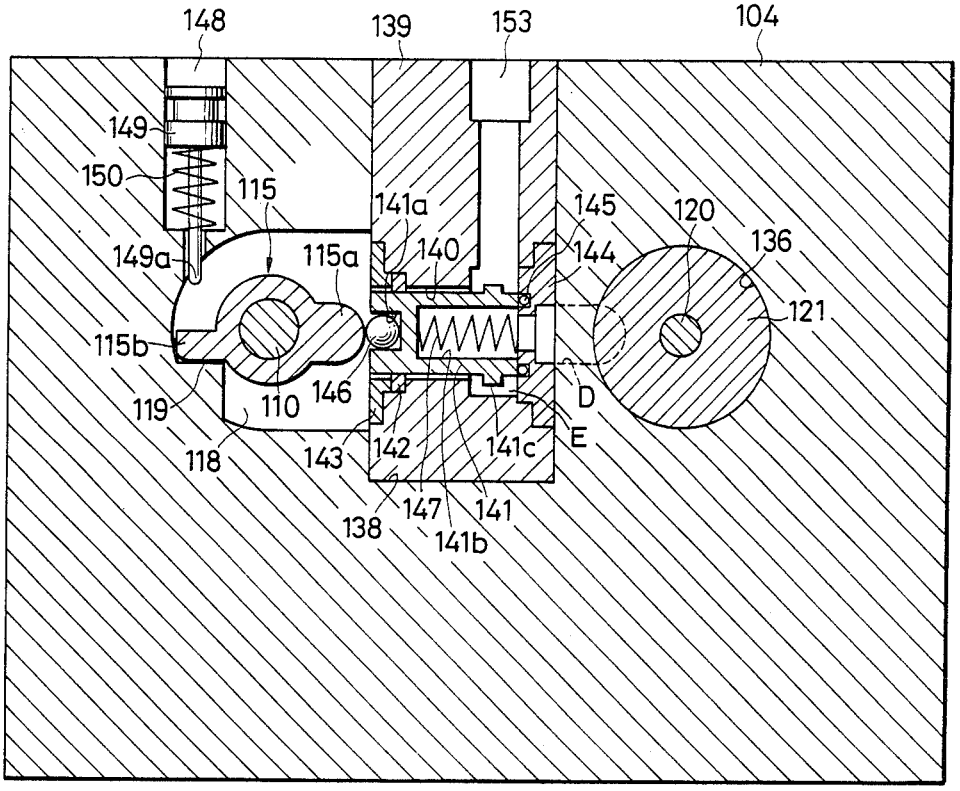
FIGS. 10 and 11 are sectional views taken along line X—X of FIG. 9 respectively showing the non-rotated and rotated states of the detection-line valve.

Also, the pneumatic valve 141 has another recess 141*b* at the rear (right) end and is urged forwardly i.e., leftwardly in FIG. 10 by a compression spring 47 having one end fitted into and supported in the recess 141*b* and interposed between the path fitting 144 and the bottom of the recess 141*b*. A rib 141*c* for preventing the pnuematic valve 141 from coming off is formed so as to protrude from the rear portion of the pneumatic valve 141. Also another valve body 139 is provided with an air supply bore 153 for supplying air to the previously described chamber E.

The cam 115 of the detection-line 108 includes a cam portion 115*a* having an essentially symmetrical, arched surface an engagement projection 115*b* both of which are radially projected. The cam portion 115*a* abuts against the steel ball 146 fitted into the pneumatic valve 141 while the engagement projection 115*b* selectively engages the stopper 119 to hold the cam 115 at the position shown in FIG. 10. In this position, the pneumatic valve 141 is moved rearwardly against the compression spring 147, the rear end of the valve 141 is brought into contact with the seal 45, and both of the chambers D and E are kept shut off from each other.

A piston 149 for reversing and resetting the cam 115 is slidably inserted into a bore 148 formed in the rear portion of the cemented board 104 and is urged rearwardly (up) by a compression spring 150 which is fitted into the bore 148. When air is supplied to the bore 148 by an air source (not shown), the piston 149 is moved forwardly against the compression spring 150. A tip 149*a* of the piston 149 projecting into the bore 118 then pushes the engagement portion 115*b* of the cam 115, which has rotated to a position shown in FIG. 11 in the downward direction in FIG. 11, thereby reversing and resetting the cam 115 to the state shown in FIG. 10.

FIG. 8 illustrates a state wherein the deflator is disposed on the metal mold 101 having at the bottom a riser 151 and a gate 152.

According to the above-described construction, during an injection molding operation, when molten metal is charged into the cavity 102, the molten metal is passed through the exhaust passage 103 and the detection passage 106, reaching the detection-line valve 108 and colliding with a side of the head 110*a* the valve rod 110. The inertial force of the molten metal causes the cam 115 together with the valve rod 110 to rotate through an angle of a degrees, and thus the cam 15 is changed from the position of FIG. 10 to the position of FIG. 11.

When the cam 115 is rotated, the pneumatic valve 141 is moved leftwardly as viewed in FIG. 11 by the force of the compression spring 147.

When the pneumatic valve 141 is moved, air is supplied to the chamber E through an air supply port 153 from an air source and a piping although neither of the are shown. However, since the chambers E and D are made to communicate with each other as the result of movement of the pneumatic valve 141, the air is supplied from the chamber E to the chamber D through the path fitting 144.

The pressure of the air supplied to the chamber D causes the piston 121 of the exhaust-line valve 109 to move together with the valve rod 120 from the position shown in FIG. 12 to the left as illustrated. The exhaust port 35 is closed as shown in FIG. 13 by the head 120*a*.

Although the molten metal reaches the exhaust-line valve 109 through the exhaust passages 103 and 107, the molten metal reaches the exhaust passage 107 later than it reaches the detection passage 106. As described above, since the exhaust-line valve 109 has already been closed, the molten metal never flows from the exhaust passage 107 into the valve.

When the molten metal has solidified, a forging machine (not shown) is actuated to perform a mold opening operation. After completion of casting, a solenoid valve (not shown) is actuated immediately before the mold opening, thereby cutting off the supply of air to the chamber E.

When a molded product is to be removed from the mold, the exhaust-line valve 109 is reset to its original state by virtue of the contraction force of the molten metal. After release of the mold, air is supplied to the port 148 by the air source and the piping (not shown), moving the piston 139 forwardly to press the engagement projection 115*b* of the cam 115, and resetting the cam 115 in a reverse direction until the engagement projection 115*b* engages with the stopper portion 119. Thus, the cam portion 115*a* causes the pneumatic valve 141 to move rearwardly against a spring force by means of the steel ball 146. Thereafter, the rear end surface of the pneumatic valve 141 is brought into contact with the seal and is held by the same, thereby disconnecting the chambers E and D. Subsequently, when air is supplied to the air supply port 153, the succeeding injection molding is prepared.

The deflator according to the present invention is constructed in the above-described manner. A detection passage 106 and an exhaust passage 107 are led from the cavity 102 of a mold. Molten metal charged into the cavity 102 of the mold reaches the two respective passage 6 and 7 with a time difference therebetween. The detection passage 106 which the molten metal reaches earlier is provided with a detection-line valve while the exhaust passage 107 which the molten metal reaches later is provided with the exhaust-line valve 109. The cam 115 is fixedly formed on the valve rod 110 in such a manner that the detection-line valve 108 can be rotated by the inertial force of the molten metal which has been injected. The air valve 141 is opened in linked relation to the rotation of the cam 115. The air supplied from the air source is delivered from the chamber E to the chamber 10 so as to close the exhaust-line valve 109 by the air presure thus produced. Therefore, unlike the conventional example, the exhaust valve does not directly perform a closing operation by means of the inertial force of the molten force, nor does the molten metal flow into the exhaust-line valve 109 since the exhaust-line valve 109 has already been closed when the molten metal reaches the exhaust-line valve 109. It is therefore possible to solve various operational problems which might be caused by the flow of the molten metal into the exhaust-line valve 109. Valve opening and closing operations can be smoothly performed, thereby ensuring deflation during an injection molding operation to mold blow hole-free, high-quality products. No hydraulic apparatus is needed to attach the deflator to the metal mold, and no alignment is required at the time of the attachment. Sine the conventional example can only be attached to the outside of the metal mold, the yield of products is inferior. However, since the deflator according to the present invention can be attached to the inside of the metal mold as well, the yield of products can be improved. Also, the attachment of the deflator to the inside of the metal mold provides the advantage that deflation is enabled at a given position of the inside of the cavity 102.

Third Embodiment

The deflators of the first embodiment succeed in solving various operational problems which might arise because by the flow of molten metal into the valve, further ensuring smooth opening and closing of the valve and positive deflation. This provides satisfactory effects. However, the valve mechanism for forming a passage between the air chamber of the detection-line valve can not be increased in size in terms of its construction limitation. It is therefore necessary to enlarge the stroke of the detection stroke. Accordingly, in order to enlarge a cross-sectional area to facilitate the passage of air, the valve mechanism still has had problems in that stepped portions of the detection valve must be increased in size, leading to an increase in the stroke of the detection valve.

The third embodiment has been devised in order to solve the above-described problems. This embodiment is intended for an inrease in the cross-sectional area passage by integrally fixing a changeover valve to a detection valve, thereby enabling reduction in operating time, a positive operation and a simple structure.

A third embodiment of the present invention will be described below in detail with reference to the drawings. A detection-line valve 201 is arranged in the following manner.

Figure 15:
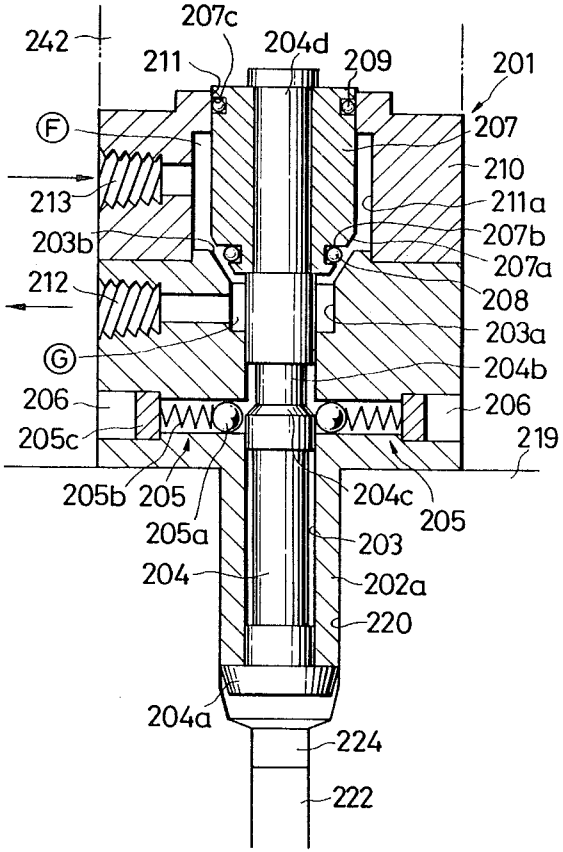
FIGS. 14 and 15 are longitudinally sectional, side elevational views of the closed state of the valve and the opened state of the same respectively showing a third embodiment of the valve mechanism of or the deflator used in the injection molding machine in accordance with the present invention.
Figure 14:
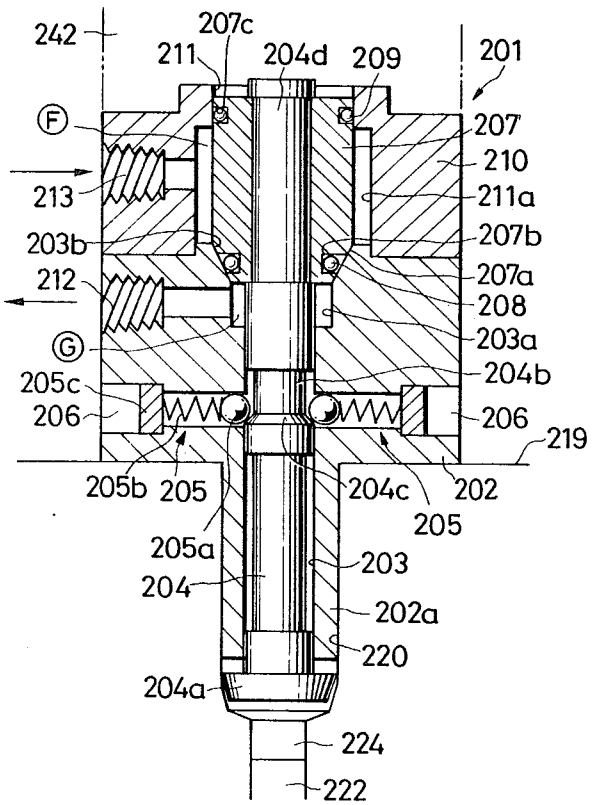

As shown in either FIG. 14 or 15, a column-shaped detection valve 204 has its stem part inserted axially, slidably and air tightly into a valve bore 203 which is vertically formed through a detection valve body 202. The lower end opening of the valve bore 203 is freely opened and closed by a valve head **204*a* disposed at the lower end of the detection valve 204**.

Steel balls **205*a* which are part of 205 which are symmetrically arranged in the detection valve body 202 are fitted into an annular groove 204*b* formed along the periphery rear the center of the detection valve 204. The steel balls 205*a* can be brought into or out of engagement with a tapered surface 204*c* formed on the lower end of the annular groove 204*b*. The detection vale 204 is arranged to be capable of being held at the valve opening position shown in FIG. 14. The application of a closing force (in the upwards direction) to the detection valve 204 causes the steel balls 205*a* to retract from the tapered surface 204*c* against two springs 205*b* by virtue of the tapered surface 204*c*. When the steel balls 205*a* are separated from the annular grooves 204*b*, the detection valve 204, as shown in FIG. 15** is closed.

The respective stoppers 205 includes the steel balls **205*a* and the springs 205*b* in transverse bores 206 which are formed substantially perpendicular to the valve bore 203 in the detection valve body 202. Pressure fittings 205*c* impart an initial deflection to the springs 105*b***.

The upper end portion of the detection valve 204 is provided with an axially elongated annular groove **204*d*. A changeover valve 207 consisting of half member is fitted onto the annular groove 204*d* and is integrally secured to the detection valve 204** by being tightened by bolts (not shown).

The periphery of the lower end of the changeover valve 207 is shaped into a tapered surface **207*a* having a small-diameter lower end. The periphery of the upper end of the changeover valve 207 and the lower tapered surface 207*a* are respectively provided with annular grooves 207*b* and 207*c*. Seal packings 208 and 209 such as O-rings for preventing air leakage are respectively fitted into the annular grooves 207*b* and 207*c***.

The upper portion of the valve bore 203 in the detection valve body 202 is formed into an enlarged diameter bore portion **203*a*. Its upper end opening is formed into a valve seat 203*b* having a tapered surface which matches the tapered surface 207*a* of the lower end of the changeover valve 207. In a state wherein the detection valve 204 is held at the opened position, the changeover valve 207 is airtightly placed on the valve seat 203*b* means of the seal packing fitted onto the tapered surface 207*a*. Thus, the detection valve body 202, the detection valve 204, and the changeover valve 207 constitute an air chamber C around the detection valve 4**.

A valve holder 210 is coaxially fixed to the upper end portion of the aforesaid detection valve body 202 by means of bolts (not shown). The changeover valve 207 is fitted into a valve bore 211 which is formed through the center of the valve holder 210. The valve 207 is capable of axially sliding together with the detection valve 204 and is airtightly sealed by the seal packing 209.

The lower portion of the valve bore 211 of the valve holder 210 is provided with an enlarged diameter bore portion **211*a*, and thus the valve holder 210 and the changeover valve 207 constitute an air chamber F around the changeover valve 207**. The air chamber F is adapted to communicate with the aforesaid air chamber G.

Bores 212 and 213 to which pipes are connected and which communicate with the air chambers G and F are respectively formed in the side walls of the detection valve body 202 and the valve holder 210. The bore 212, as shown in FIG. 16, communicates with an air chamber H of an exhaust-line valve 215 through a pipe 214 while the bore 213 is connected to an air source (not shown) through a pipe 216.

Figure 16:
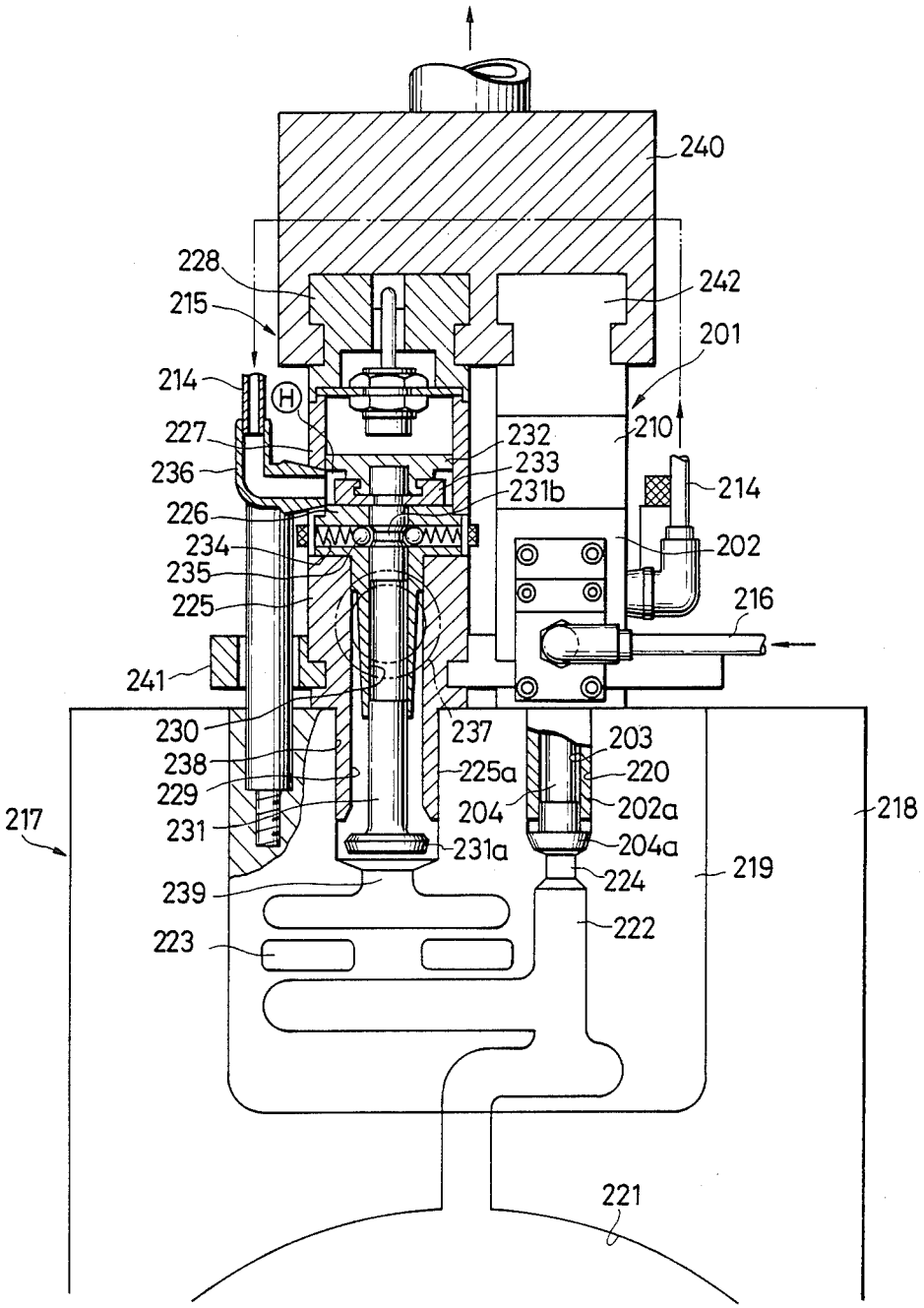
FIG. 16 is a partially sectional, side elevational view of the deflator of the third embodiment.

The lower end portion of the detection valve body 202 is formed into a cylindrical portion 202*a* and, as shown in FIG. 16, is vertically slidably and airtightly inserted into an insertion groove 220 in a cemented board 219 disposed on the separation surface portion between a fixed die (not shown) of a metal mold 217 and a movable die which is shown. A detection passage 222 and a exhaust passage are led from a cavity 221 of the metal mold 217. The insertion groove 220 communicates with the detection passage 222 through a vent runner 224.

The deflator, as shown in FIG. 16, is constituted by the detection-line valve 201 and the exhaust-line valve 215. The exhaust-line valve 215 is arranged in the following manner.

As shown inFIG. 16, an exhaust valve body 225, an exhaust valve guide 226, an exhaust spacer 227 and an exhaust base 228 are coaxially fastened together by bolts (not shown). A column-shaped exhaust valve 231 having a valve head 231*a* at the lower end has its stem part axially slidably inserted into an exhaust bore 229 in the exhaust valve body 225 and into a valve bore 230 in the exhaust valve guide 226. The exhaust valve 231 can freely open and close the exhaust bore 229. An exhaust piston 232 for moving the exhaust valve 231 upward is fixed to the upper end of the exhaust valve 231 by means of a piston fixture 233. The exhaust piston 232 is slidably inserted into the aforesaid exhaust spacer 227. Thus, the exhaust valve guide 226, the exhaust spacer 227, the piston 232 and the fixture 233 define the air chamber H.

An annular groove 231*b* is formed around the periphery of the upper portion of the exhaust valve 231. Steel balls 235 are slidably inserted into transverse bores 233 which are symmetrically formed through the width of the exhaust valve guide 226. The steel balls 235 which are urged by springs 234 are fitted into the annular groove 231*b* of the exhaust valve 231 so that they can be brought into or out of engagement with the groove 231*b* by the application of an axial force to the exhaust valve 231. In consequence, the exhaust valve 231 is held at the illustrated opened position.

A pipe elbow 236 is air tightly screwed into the side wall of the exhaust spacer 227 to communicate with the air chamber H, and the piper 214 of the detection-line valve 201 is connected to the elbow 236.

An exhaust-bore 237 is opened in the side wall of the exhaust valve body 225. The exhaust bore 237 is connected to a vacuum pump (not shown) so that gas can be expelled through an exhaust pipe (not shown). The timing of evacuation performed by the vacuum pump is controlled by a limit switch and a solenoid valve although neither are shown.

The lower portion of the exhaust valve body 225 is formed into a cylindrical portion 225*a*. In the same manner as in the detection-line valve 201, the cylindrical portion 225*a* of the exhaust valve body 225 is slidably inserted into an insertion groove 238 in the a cemented board 219 in which the inserting groove 238 communicates with the exhaust passage 223 through a vent runner 239.

The detection passage 222 and the exhaust passage 223 are formed in such a manner that the molten metal charged into the cavity 221 during injection molding can reach the two passages 222 and 223 with a time difference therebetween. Specifically, molten metal reaches the detection passage 222 earlier than it does the exhaust passage 223.

The detection-line valve 201 and the exhaust-line valve 215 are detachably mounted as a unit on a connecting fitting 240 and a holding plate 241, and they can vertically move by a predetermined stroke by means of a hydraulic cylinder attached at the upper side.

The exhaust-line and the detection-line valves 215 and 201 are respectively held to the connection fitting 240 by the exhaust base 220 and a detection base 242.

The operation of the present invention will now be described. When molten metal is charged into the cavity 221 during injection molding, the molten metal is passed through the detection passage 222 and the vent runner 224 and collides against the valve head 204*a*, thereby pushing it upwardly. Thus, when the steel balls 205*a* are pressed outwardly against the spring force owing to the tapered surface 204*c* of the detection valve 204, the detection valve 204 is released from the held opened state. Since the detection valve 204 and the changeover valve 207 are integrally fixed to each other, they are made to rise at the same time. The changeover valve 207 is separated from the valve seat 203*b* of the detection valve body 202, and the air chambers F and G are thereby connected together as shown in FIG. 15. In advance, the high-pressure air supplied to the air chamber F from the air source flows throught he air chamber F into the air chamber G and thereafter being supplied to the air chamber H of the exhaust-line valve 215 through the pipe 214.

This air moves the exhaust valve 231 upwardly, closing the exhaust bore 229. But during this time while the exhaust bore 29 is opened, the gas in the cavity 221 is passed through the exhaust passage 223 on the exhaust-line valve 215, passed through the vent runner 239 and the exhaust bores 229 and 237, sucked by a vacuum pump, and expelled to the exterior.

During this time, molten metal passes through the exahust passage 223 and reaches the vale head 231*a* of the exhaust valve 231, but, since the exhaust-line valve 215 has already been closed, no molten metal flows into the exhaust valve 231.

When molten metal solidifies and a forging machine (not shown) is actuated to open the mold, a hydraulic cylinder (not shown) is operated to move the deflator upwardly. Also, since a contraction force when the molten metal solidifies acts on the detection and exhaust valves 204 and 231 of the detection-line and exhaust-line valves 201 and 215, when a molded product is removed from the metal mold 217, the valves 204 and 231 are reset to their opened states at the same time and the deflator gets ready for deflation in the succeeding deflation.

The valve mechanism for a deflator used in injection molding machines in accordance with the present invention is constructed as described above. The valve mechanism for forming or breaking the communication between the air chambers F and G in the detection-lin valve 201 is incorporated in the deflator in which the detection-line valve 201 is caused to close by the inertial force of molten metal to provide communication between the airs chambers F and G. The air supplied by the air source is supplied to the air chamber H of the exhaust-line vale 215 through the air chamber H. The gas within the cavity is expelled by the time that the air pressure makes the exhaust-line valve 215 to close.

Since the changeover valve 207 is integral with the detection valve 4 to enable an increase in a sectional area through which air is passed, the stroke of the valve operation can be reduced to shorten the operating time. Since the changeover vale 207 is actuated in direct relation to the behavior of the detection valve 204, the positive operation of the vales is ensured and this provides a smooth and positive deflation. From the fabrication viewpoint as well, since the number of parts is reduced and the structure is simplified, assembly becomes easy. In addition, since it becomes unnecessary to adjust spring forces, the effects of low-cost production or the like can be provided.

Fourth Embodiment

Figure 17:
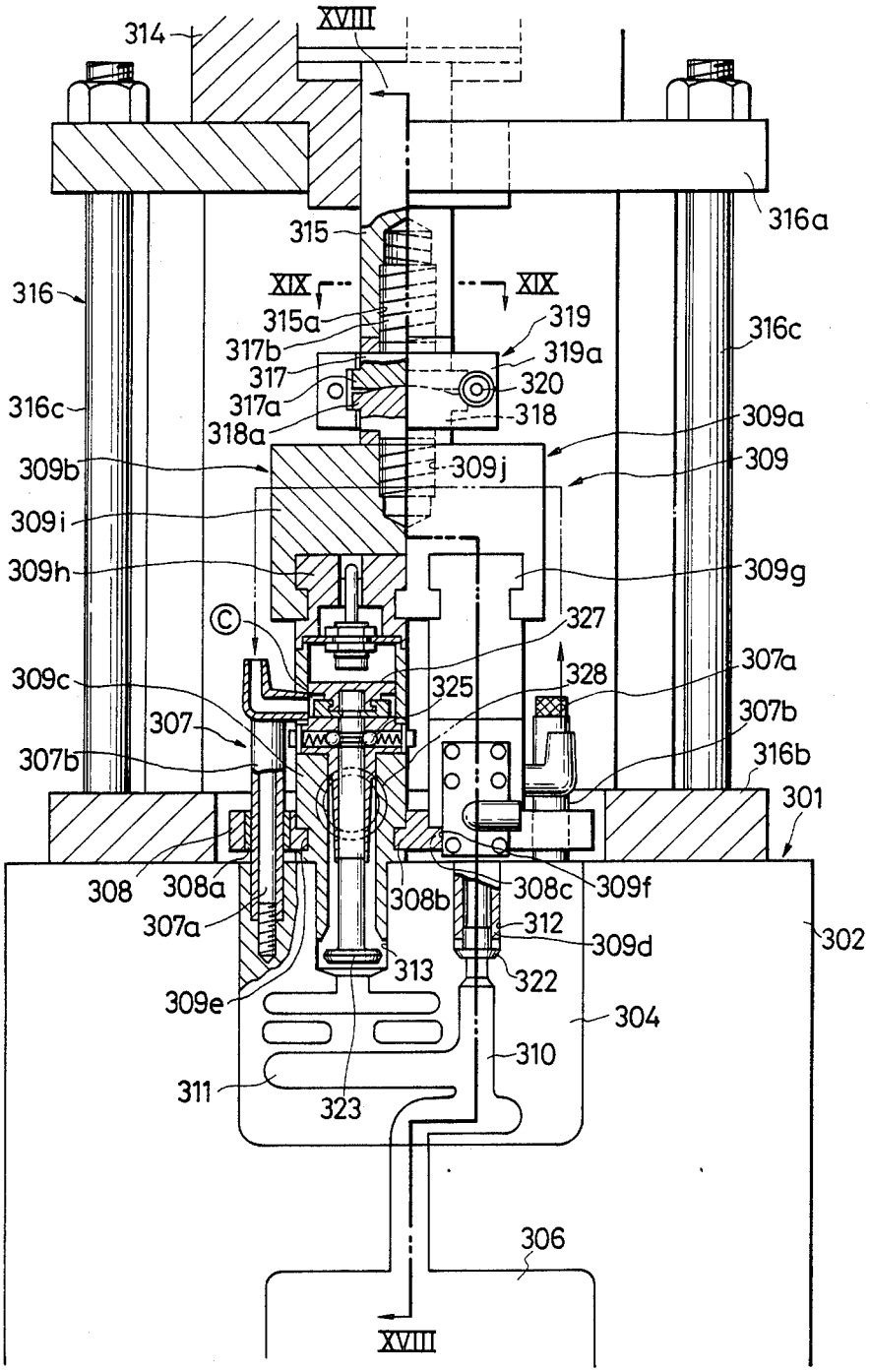
FIG. 17 is a partially cross-sectional, front elevational view of a fourth embodiment of a metal mold apparatus for use in injection molding machines in accordance with the present invention.
Figure 18:
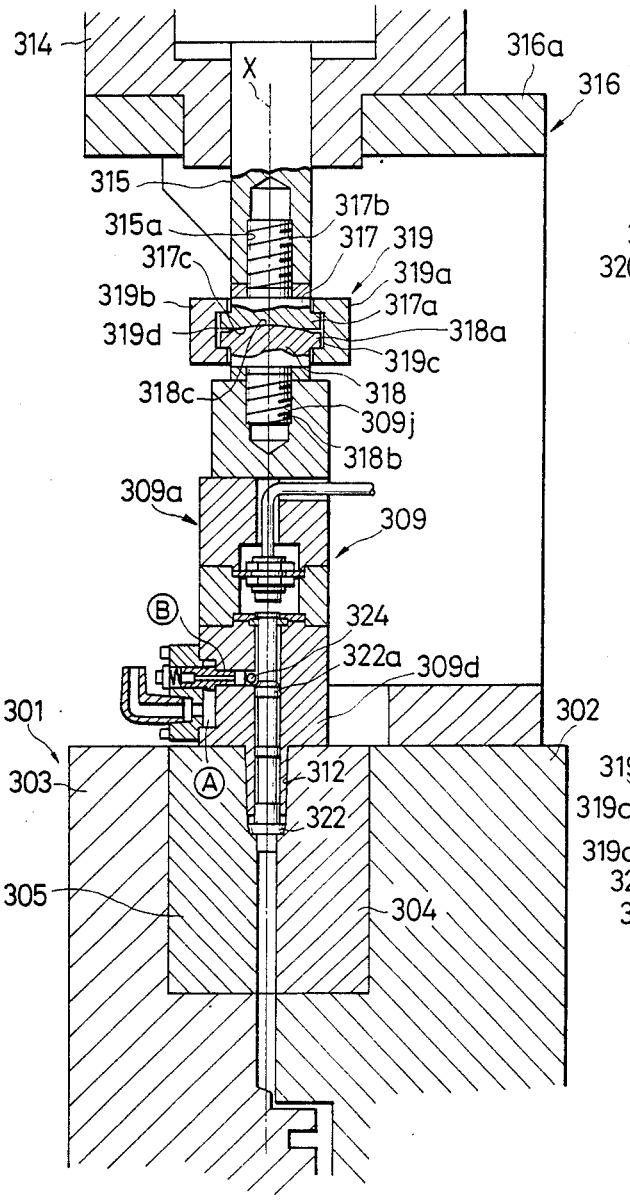
FIGS. 18 and 19 are respectively cross-sectional views taken along lines XVIII—XVIII and XIX—XIX of FIG. 17.

A fourth embodiment of the present invention will be described in detail with reference to the drawings. As shown in FIGS. 17 and 18, a metal mold 301 is constituted by a movable die 302, a fixed die 303 and cemented boards 304 and 305 respectively fixed to the separation surface portions of these dies, and in addition includes a cavity 306 formed in each of the separation portions of the movable, fixed dies 302 and 303.

A valve body holding plate 308 is vertically slidably disposed on the aforesaid movable cemented board 304 with a guide 307 being interposed therebetween. A deflator is fixed to the valve body holding plate 308.

The guide 307 is arranged in such a manner that a guide bush 308*a* of the valve body holding plate 308 is slidably inserted into a guide collar 307*b* which is fastened by a bolt 307*a* of the movable cemented board 304, thereby enabling determination of the sliding position of the deflator 309 and its smooth vertical movement.

In the illustrated example, a deflator 309 is constituted by a detection-line valve 309*a* and an exhaust-line valve 309*b*. Protruding portions 308*b* and 308*c* of the valve body holding plate 309 are respectively fitted into recessed portions 309*e* and 309*f* which are cut out from respective valve bodies 309*c* and 309*d*. Thus, the detection-line and exhaust-line valves 309*a* and 309*b* are fixed to the valve body holding plate 309. A detection base 309*g* and an exhaust base 309*b* disposed on the respective upper ends of the detection-line and exhaust-lin valves 309*a* and 309*b* are fixedly arranged side by side by means of a connecting metal member 309*i*. However, the deflator 309 is not limited solely to the illustrated example. As another example, the apparatus consisting of a single exhaust valve as disclosed in Japanese Patent Publication No. 46387/1983 may be employed, and an apparatus arranged to close a valve by virtue of the inertial force of molten metal at the time of injection is also available.

The respective lower ends of the valve bodies 309*c*, and 309*d* of the detection-line valve 309*a* and of the exhaust-line valve 309*b* for use in the illustrated deflator 309 are disposed side by side at the separation surface portions of the movable and fixed cemented boards 304 and 305, and are vertically slidably inserted into insertion bores 312 and 313 which communicate with exhaust passages 310 and 311 led from the cavity 306. A rod 315 of a hydraulic cylinder 314 and the connecting metal member 309*i* are coupled so that the previously mentioned lower ends can be made to vertically slide by means of the hydraulic cylinder 314 in synchronization with an injection molding cycle (mold closing—product removal). According to the present invention, the foresaid members are coupled in the following manner.

A cylinder base 316 whose frame consists of an upper base plate 316*a*, a lower base plate 316*b*, and a plurality of connecting rods 316*c* is fixed to the movable die 302. The hydraulic cylinder 314 is fixed to the upper base plate 316*a* of the base 316 on the same as X as that of the deflator 309.

The connecting metal member 309*i* and the rod 315 of the hydraulic cylinder 314 are connected by two joints 317 and 318, the casing 19 and bolts 20.

Figure 19:
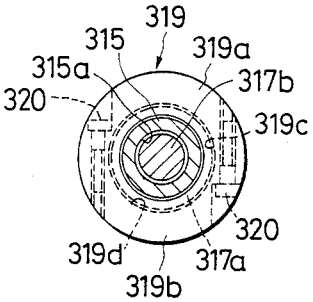

As shown in FIGS. 17 to 19, the joints 317 and 318 are respectively provided with flanges 317*a*, and 318*a* at the outer circumferences of the facing ends and with threaded rods 317*b* and 318*b*. A spherical seat 317*c* of a circulat shape in plane view is recessed in the facing surface of the joint 17 while a spherical projection 318*c* having circular shape inplane view and the same curvature as that of the spherical seat 317*c* protrudes from the other joint 318.

A casing 319 is formed in a plane annular shape by making casing members 319*a* and 319*b* which are formed by two divided members each having a semicircular shape in plane view. Semi-annular grooves 319*c* and 319*d* are formed face to face with each other along the inner surfacers of the respective casing members 319*c* and 319*d*. Thus, the coupling of the casing members 319*a* and 319*b* provides an annular groove in plane view along the inner circumference. Also, the casing members 319*a* and 319*b* are fastened as a unit by the bolts 320.

In this manner, the rod 15 and the connecting metal member 309*i* of the deflator 309 are coupled by means of the respective joints 317 and 318 and the casing 319. However, at this time, the respective threaded rods 317*b* and 318*b* of the joints 317 and 318 are screwed into threaded bores 315*a* and 309*i* in the centers of the rod 315 and of the connecting metal member 309*i*. As a result the joint 317 and the joint 318 are respectively fixed to the rod 315 and the connecting metal member 309*i*. Then, the spherical seat 317*c* of the joint 317 is made to but the spherical projection 318*c* of the joint 318, being covered with the aforesaid casing members 19*a*, 19*b* from the outside. The flanges 317*a* and 318*a* of the joints 317 and 318 are engaged with each other and inserted into the respective grooves 319*c* and 319*d*. Then, the casing members 319*a* and 319*b* are fastened as a unit by the bolts 320 so as to movably hold the joints 317 and 318 in the casing 319 on the same axis X, thereby connecting the rod 315 and the connecting metal member 309*i*.

The diameters of the flanges 317*a* and 318*a* of the joints 317 and 318 are made smaller by a suitable degree than those of the grooves 319*c* and 319*d* of the casing members 319*a* and 319*b*. The joints 317 and 318 are thus held in the casing 319 for movement perpendicular to the axial direction.

Figure 20:
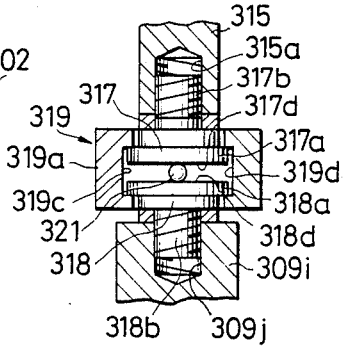
FIG. 20 is a longitudinally sectional view of another embodiment of the joint portion of the fourth embodiment.

The joints 317 and 318 are not necessarily provided with the sperical seat 317*c* and the spherical projection 318*c* on their respective facing surfaces in the above-described manner. As shown in FIG. 20, flat surfaces 317*d* and 318*d* are merely formed and a steel ball 321 is movably interposed between the flat surfaces 317*d* and 318*d* in the casing 319. In the case of this equivalent arrangement as well, since the joints 317 and 318 are coupled with the spherical surface of the steel ball 21 interposed therebetween, it is possible to smoothen the axial and vertical movement as between teh joints 317 and 18.

The operating state of the illustrated deflator 309 will now be briefly described.

During injection molding, respective valves 322 and 323 of the detection-line and exhaust-line valves 309*a* and 309*b* are held at the illustrated opened state by stoppers 324 and 325. The molten metal which has been injected advances through the detection passage 310 earlier than it does through the exhaust passage 311, striking on and pushing the detection valve 322 upward to cause it to close. Thus, the stopper 324 is laterally moved against a spring force by virtue of an enlarged portion 322*a* of the valve 322, causing the piston 326 to move. This provides communication between the chambers A and B.

The chamber A is supplied with air from an air source (not shown), and accordingly the air is made to flow from chamber A to chamber B. This air is then supplied to a chamber C of the exhaust-line valve 309*b* which is connected to the chamber B by a hose (not shown). The piston 327 disposed on the upper end portion of the valve 323 is pushed upward, thereby causing the valve 323 to move to its closed position.

Figure 21:
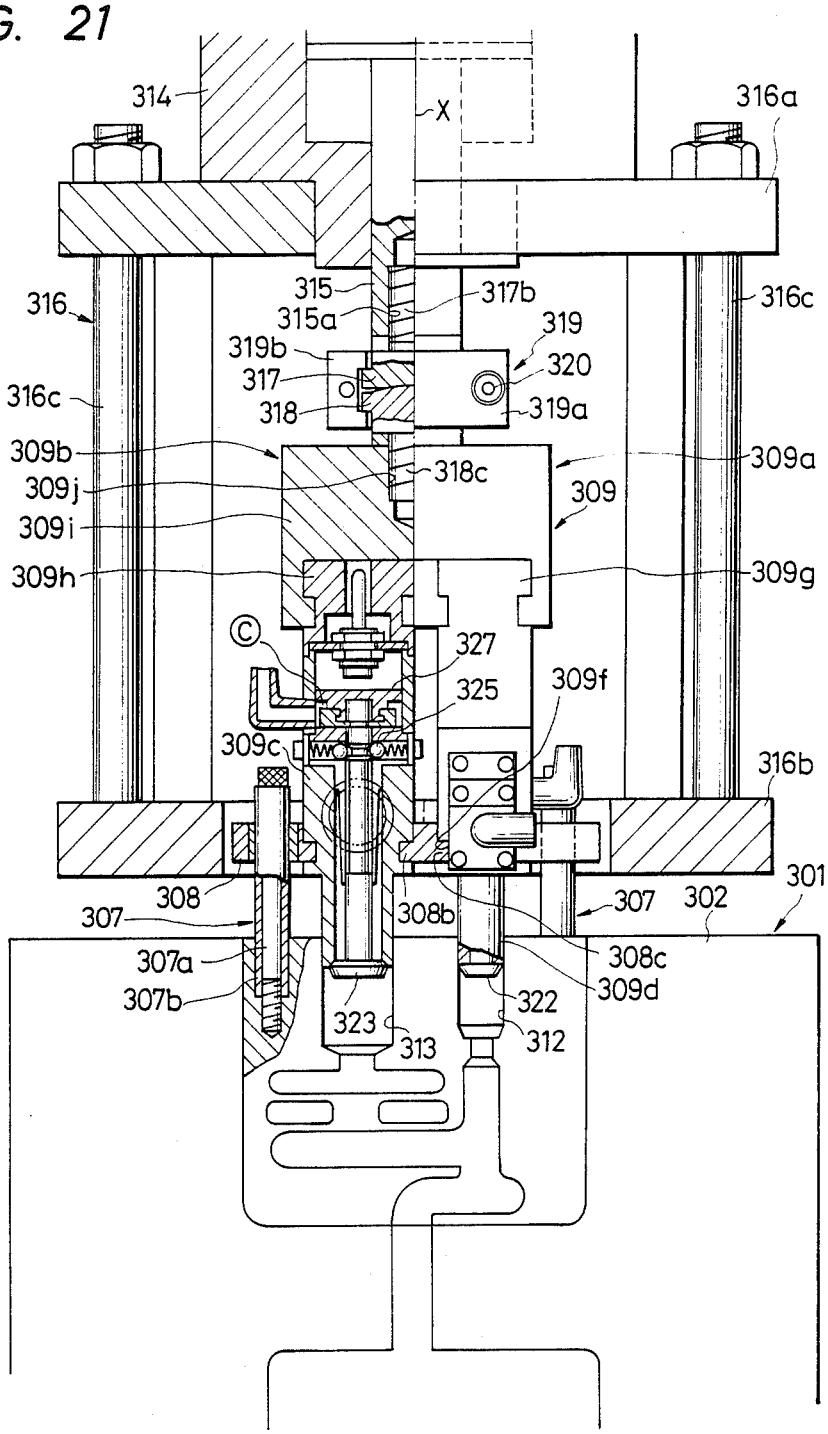
FIG. 21 is a partially cross-sectional, front elevational view of the fourth embodiment, but showing the pulled-up state of the deflator.

During this time, the gas in the cavity 306 is passed through the exhaust passage 311, expelled outwardly through an exhaust bore 28 of the exhaust-line valve 9*b*. When the molten metal flowing in the exhaust passage 11 reaches the exhaust valve 23, the exhaust valve 23 has already been closed in the above-described manner. Therefore, no molten metal flows into the exhaust-line valve 309*b* but only the gas is expelled. Following the injection molding, the deflator 309 is pulled upward as shown in FIG. 21 by the hydraulic cylinder 314. However, since the deflator 309 is held by the valve body holding plate 308 which is made to slide vertically by a guide means 307, the deflator 309 is moved upward along the same axis X as those of the insertion bores 312 and 313 of the respective movable and fixed cemented boards 304 and 305.

Subsequently, after the product has been removed from the opened mold and the mold has been again closed, the deflator 309 is pushed downward by the hydraulic cylinder 314 in synchronization with the mold closing. At this time, the valves 322 and 323 of the detection-line and exhaust-line valves 309*a* and 309*b* are respectively caused to an open, resuming the states shown in FIGS. 17 and 18 in which the deflator 306 gets ready for the deflation at the time of the succeeding injection molding.

The metal apparatus for use in injection molding machines in accordance with the present invntion is constructed in the above-described manner. The valves are slidably inserted into the insertion bores 312 and 313 formed in the movable and fixed cemented boards 304 and 305 of the metal mold 301 so that the valves are opened and closed in synchronization with an injection molding cycle so as to expel the gas from the cavity. The deflator 309 is mounted on the metal mold so that it can vertically slide by means of the hydraulic cylinder 314 in synchronization with an injection molding cycle. The deflator 309 is supported by the valve body holding plate 308 which is mounted on the movable cemented board 304 for vertically sliding movement along the guide 307. The connecting metal member 309*i* and the hydraulic rod 315 are coupled in such a manner that the spherical surfaces of the joints 317 and 318 connected to the respective elements 309*i* and 315 are made to axially butt against each other and are movably held in the casing 319. This makes it easy to mount and align the deflator 309 and the hydraulic cylinder 314 with respect to the metal mold 301. Even if the alignment between the deflator 309 and the hydraulic cylinder rod 315 is imperfect, the tolerance is absorbed by the movements of the joints 317 and 318 in the axial and perpendicular directions. Therefore, since the deflator 309 is never inserted into the movable and fixed cemented boards 304 and 305 of the metal mold 301 in an inclined manner, no scratch is formed on its sliding surface, nor is the deflator 309 eccentrically driven by the hydraulic cylinder rod 315. Accordingly, the present invention provides the effects of smoothening the vertically sliding movement of the deflator 309 and the valve opening and clsoing operations of the same and of ensuring a positive deflation.

Fifth Embodiment

Figure 25:
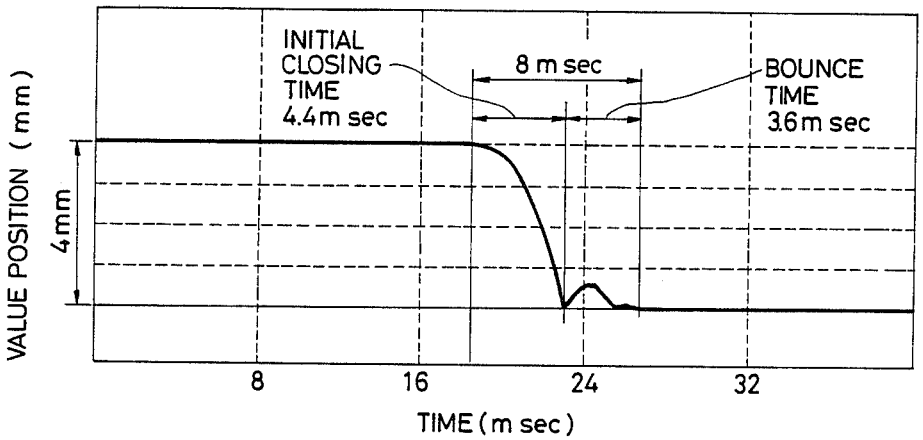
FIG. 25 and 26 are graphs showing the results of measurement of rebounding at the time of the closing operation of the conventional exhaust valve for FIG. 25 and of the exhaust valve of FIGS. 22–24 for the data of FIG. 24.

In both the conventional deflators and some of the embodiments invention, at the moment that the detection valve and exhaust valve are closed by the action of molten metal, these valves collide against the valve seats of the respective valve bodies and this makes the valves to rebound. This motion is shown in the graph of FIG. 25 for a conventional valve. Thus, since the speed of advance of the molten metal is high at the time of valve rebounding, the molten metal may flow into the valve body through the exhaust port. Thisl eads to various problems relating to mis-operation of the valves. Furthermore, since the total valve operation time is prolonged, it is necessary to decrease the advancing speed of the metal passing through the exhaust passage or to delay the time at which the molten metal reaches the exhaust valve. Accordingly, the production rate is lowered.

Figure 22:
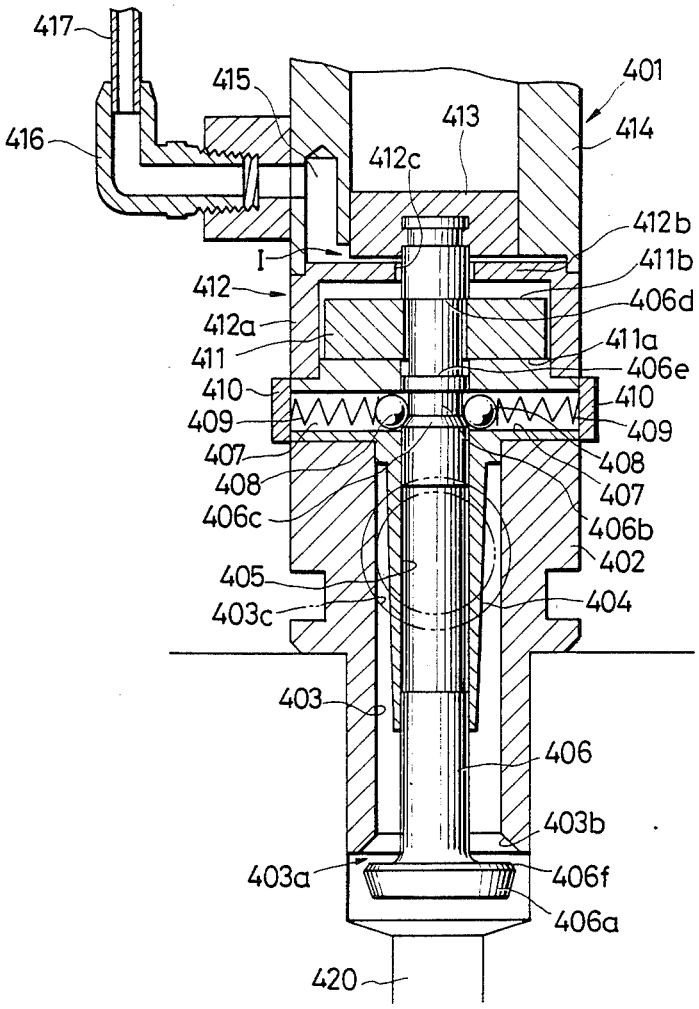
FIGS. 22 and 23 are longitudinally section a, front elevational views showing respectively a valve-opened state and a valve-closed state of fifth embodiment of the invention, which includes a mechanism for preventing the rebounding of an exhaust valve of a deflator.
Figure 23:
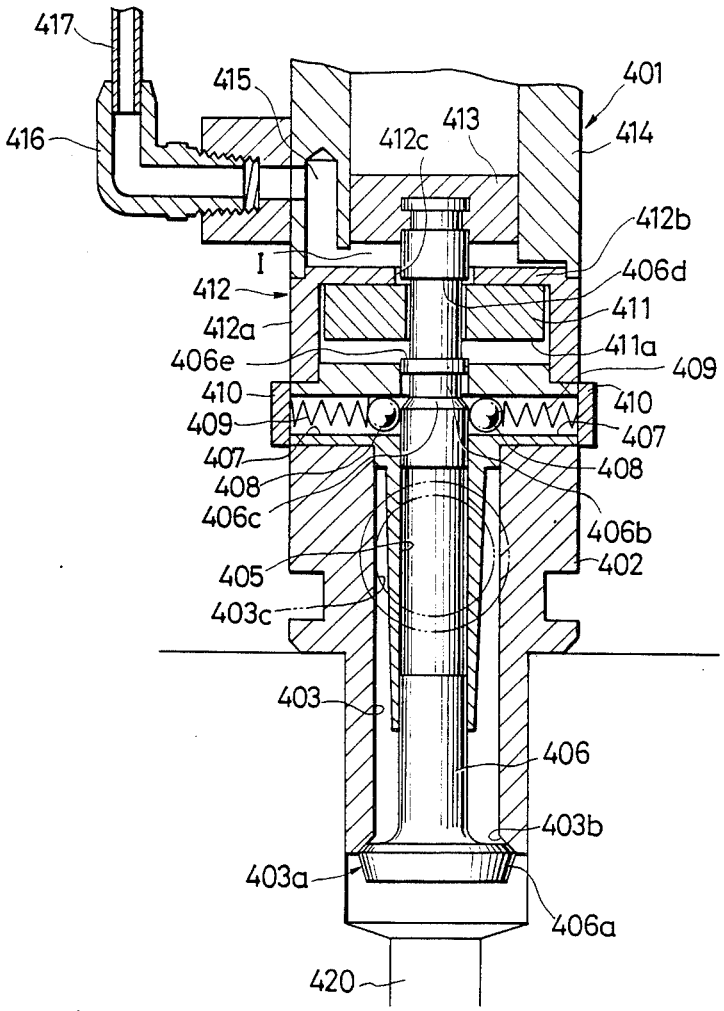

A detailed description will be made below of a fifth embodiment of the invention with reference to the drawings of FIGS. 22 to 25. Referring to FIGS. 22 and 23 showing an exhaust-line valve 401, an exhaust bore 403 is vertically drilled inthe center of an exhaust valve body 402. A column-shaped exhaust valve 406 is axially slidably inserted into a valve bore 405 in an exhaust valve guide 404 inserted into the upper portion of the exhaust bore 403 which is located at an upper position of the exhaust valve body 402. A valve head 406 at the lower end of the exhaust valve 406 can freely open and close an exhaust port 403*a*.

An annular groove 406*b* is formed along the periphery of substantially the center of the exhaust valve 406. Transverse bores 407 are symmetrically drilled into the valve guide 404 in correspondence with the annular groove 406*b*. Steel balls 408 are fitted into the respective transverse bores 407. The balls 408 are urged by springs 409 so that they can engage with and disengage from the annular groove 406*b*. Thus, the exhaust valve 406 is disposed so that it can be held in an opened state as shown in FIG. 22 by the biased balls 408. Also, fittings 410 fixed to the exhaust valve guide 404 impart an initial deflection to the springs 408.

Also, a tapered surface 406*c* is formed at the lower end of the annular groove 406*b* and thus the steel balls 408 are retracted against a spring force by application of an upward force to the exhaust valve 406 so that the exhaust valve 406 can be released from its retained state.

In addition, an upper or stem portion of the exhaust valve 406 extending upwardly from the exhaust valve guide 404 is made smaller in diameter than the other portions and thus stepped portions 406*d* and 406*e* are formed on the inner periphry of the upper portion of the exhaust valve 406 at a suitable interval in the axial direction. An absorption plate 411 is fitted onto the exhaust valve 406 for axially sliding movement as between the stepped portions 406*d* and 406*e*.

The absorption plate 411 consists of half formed members which are fitted onto the exhaust valve 406 and are united by bolts (not shown). The absorption plate 411 is axially slidably disposed in an absorption casing 412 which is coaxially fixed to the upper portion of the exhaust valve guide 404. The absorption casing 412 serves as a travel guide and a stopper for the absorption plate 411 and is constituted by a peripheral wall 412*a* and a top wall 412*b* substantially in the shape of a cup which opens downwardly. When the exhaust valve 406 is caused to perform its closing operation, the lower stepped portion 406*e* collides against a lower end surface 411*a* of the absorption plate 411. Thus the absorption plate 411 is bounced or rebounded upwardly away from the lower stepped portion of the exhaust valve 406, as shown in FIG. 23. Also, since the absorption plate 411 is arranged to be stopped, the stepped portion 406*d* of the exhaust valve 406 prevents the exhaust valve 406 from coming off by coming into contact with an upper end surface 411*b* of the absorption plate 411.

Preferably the absorption plate 411 has a weight approximately equal to that of the exhaust valve 406. The mounting position is not limited to the upper portion of the exhaust valve 406, as shown, and an intermediate portion or either end portion may be selected.

Also, a piston 413 consisting of half members united by bolts (not shown) is fixed to the upper end of the exhaust valve 406. The piston 413 is slidably fitted into an exhaust spacer 414 which is coaxially fixed to the absorption casing 412. An air chamber I is formed between the top wall 412*b* of the absorption casing 412 and the pistion 413. An air supply bore 415 is formed in the side wall of the exhaust spacer 414 having an opened inner end which communicates with the air chamber I. The supply bore 415 is connected to one end of a hose 417 by a pipe elbow 416. The other end of the hose 417 is connected to an air chamber of a detection valve which will be described later.

Figure 24:
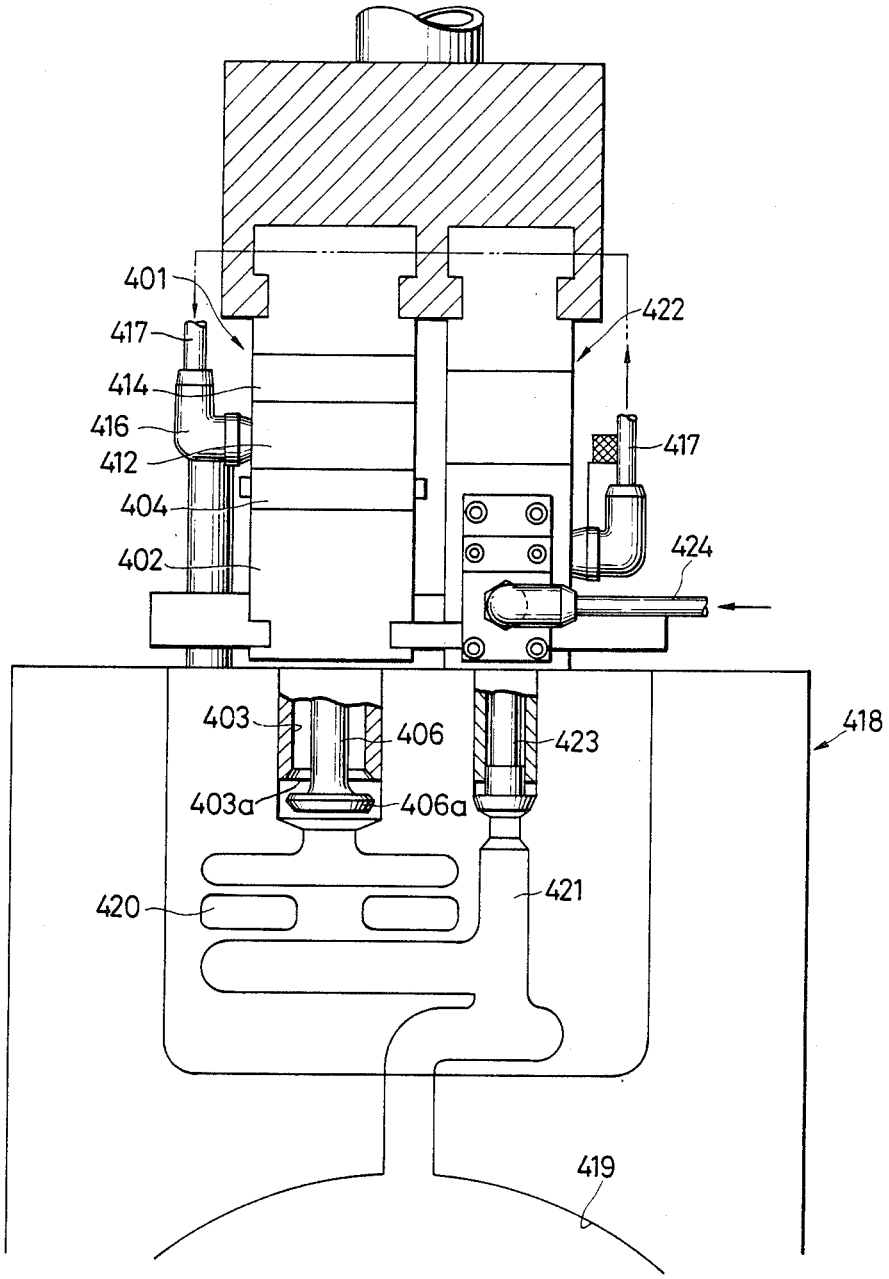
FIG. 24 is a partially sectional, front elevational view of an example of a deflator provided with the same embodiment.

The illustrated example of a deflator, as shown in FIG. 24, includes an exhaust passage 420 and a detection passage 421 led from a cavity 419 of a metal mold 418. The exhaust and detection passages 420 and 421 are respectively provided with the above-described exhaust-line valve 401 and a detection-line valve 422. During injection modling, the molten metal charged into the cavity 419 advances straight through the detection passage 421 and reaches the detection-line valve 422. When the detection valve 423 is caused to close by the inertial force of the molten metal, one air chamber to which air is supplied through the hose 424 by an air source (not shown) communicates with the other air chamber. Such two air chambers (not shown) connected by are selectively cross-coupling valve (not shown) in such a manner as to enable the mutual communication and cutoff of the detection-lin valve 422. Air in one of the air chambers is supplied through the hose 417 to the air chamber I of the exhaust-line valve 401. The pressure of this air causes the piston 413 to ascend together with the exhaust valve 406. Thus, the closing operation is effected not directly by molten metal but in directly by air. During this time, the gas in the cavity 419 is allowed to pass through the exhaust passage 420, the exhaust bore 403 and the exhaust port 403*c*, and is discharged to the exterior by a vacuum pump (not shown).

Also, the exhaust valve 420 to which the exhaust-line 401 is attached is formed so that molten metal may reach the valve 420 later than it may reach the detection passage 421. When the molten metal reaches the exhaust port 403*a*, the exhaust port 403*a* has already been closed by the exhaust valve 406. Accordingly, no molten metal flows into the valve through the exhaust port 403*a*.

The deflator is not limited to the illustrated example, and there is another example having a known structure in which the exhaust valve directly performs a closing operation by virtue of the directly applied inertial force of the molten metal. In this case, the exhaust-line valve does not require the previously described piston 413.

Incidentally, the valve head 406*a* of the exhaust valve 406 is provided with the tapered surface 406*f* (FIG. 22). A valve seat 403*b* of a tapered shape is formed at the exhaust port 403*a* of the exhaust valve body 402 so that, during a closing operation, the tapered surface 406*f* is capable of coming into airtight contact with the valve seat 403*b*.

Accordingly, according to the aforesaid arrangement, when the detection valve 423 is caused to close by the inertial force of the molten metal during injection modling, the valve means (not shown) of the detection-line valve 422 is operated to provide communication between the two air chambers. The air which is supplied to either of the two chambers from the air source is supplied to the other air chamber, high-pressure air being supplied to the air chamber I through the hose 417, the elbow 416 and the air supply bore 415.

Since this air supply pushes the piston 413 upwardly, the exhaust valve 406 which has been held at an opened position as shown in FIG. 22 by stopper means consisting of the steel balls 8 and the springs 9 is moved upwardly together with the piston 413. Thus the valve head 406*a* closes the exhaust port 403*a* and the exhaust valve 401 is closed. But at this time the stepped portion 406*e* of the exhaust valve 406 collides against the lower end surface 411*a* of the absorption plate 411 to make the plate 411 fly upwardly. In consequence, the kinetic energy of the exhaust valve 406 is absorbed by the absorption plate 411.

The absorption plate 411 which has been hit upwardly strikes on the top wall 412*b* of the absorption casing 412. Further upward movement is prevented so that the absorption plate 411 is caused to stop as shown in FIG. 23.

In this manner, since the absorption plate 411 absorbs the kinetic energy during the closing operation of the exhaust valve 406, the kinetic energy of the exhaust valve 406 is reduced so that the exhaust port 403*a* is positively closed by the valve head 406*a* without any rebounding of the exhaust valve 406.

Afterwards, the exhaust valve 406 and the detection valve 423 are restored to the opened state by the contraction force of the molten metal which is solified, and are retained at the position by the stopper means.

Figure 26:
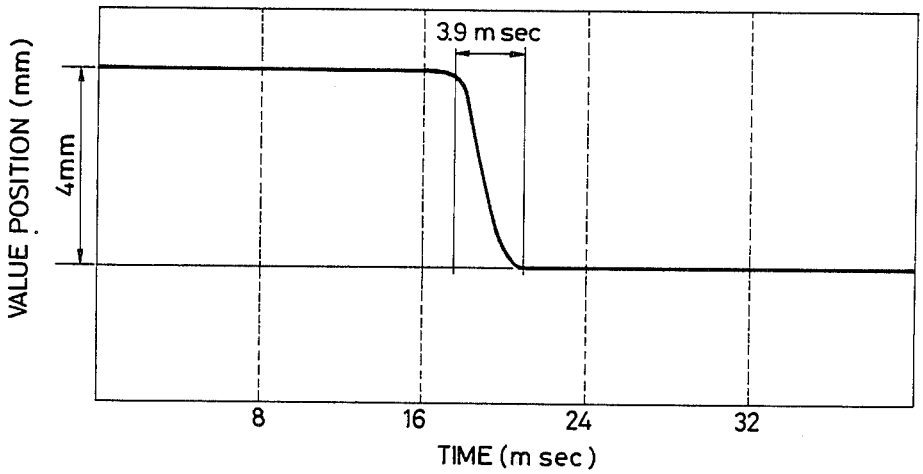

FIG. 25 is a graph showing data obtained from the measurement of the bounding state of the conventional exhaust valve and FIG. 26 is a corresponding graph for the exhaust valve 406 of the invention. As is evident from FIG. 25, the duration of rebounding is only slightly shorter than the time initially taken for the first closing of the conventional exhaust valve and the rebound distance is a non-negligible 0.6 mm. However, FIG. 26 shows that the exhaust valve 406 of the invention demonstrates significantly reduced rebounding.

The mechanism for preventing the rebounding of the exhaust valve of the deflator for use in injection molding machines in accordance with the present invention is constructed in the manner described above. During injection molding and after deflation, when the exhaust valve 406 is caused to close directly or in directly by molten metal. The exhaust valve 406 collides against and hits the absorption plate 411 upwardly. Therefore, the kinetic energy of the exhaust valve 406 is absorbed by the absorption plate 411 and thus decays, thereby preventing there bounding of the exhaust valve 406. Accordingly, since the exhaust port 403*a* of the exhaust valve body 402 can be instantaneously and positively closed, no molten metal flows into the exhaust valve 406 through the exhaust port 403*a*. This solves various problems which might be caused by the flow of molten metal into the valve. Also since the rebounding time has decreased, the time required for the clsoing operation of the exhaust valve 406 is shortened and this provides a variety of excellent effects coupled with a high-speed advance of the molten metal. In addition to this effect, the faster closing speed allows faster production rates. Moreover, all that is required from the structural viewpoint is that the stepped portions are formed at suitable positions in the exhaust valve 406, the absorption plate 411 being merely fitted onto the valve 406 between the stepped portions. Accordingly, such a simple arrangement provided the effect of low-cost production of deflators.

What is claimed is:

1. A deflator for use in an injection molding machine having a cavity which is filled with a liquid comprising:

a first exhaust passage and a second exhaust passage led from said cavity;

a detection line valve disposed in a first position on said first exhaust passage and having a movable face facing said first exhaust passage and being movable in a direction of an axis of said first echaust passage at said first position, whereby an inertial force of said liquid in said first exhaust passage moves said face against a biasing force;

biasing means for providing said biasing force;

an exhaust line valve disposed in a second position on said second exhaust passage, said liquid filling said cavity reaching said first position before reaching said second position;

gas pumping means connected to said second exhaust passage through said exhaust line valve; and first pneumatic means responsive to a position of said face of said detection line valve for closing said exhaust line valve.

2. A deflator as recited in claim 1, wherein said second passage has formed therein a plurality of steps.

3. A deflator as recited in claim 1, wherein said detection line valve comprises a valve seat and a valve stem integral with a head with said face and seatable on said seat and movable along said direction of said axis of said first exhaust passage.

4. A deflator as recited in claim 3, wherein said pneumatic means includes an air source and valve means gating said air source to said exhaust line valve and biased to be closed by said biasing means, said valve stem having an axial non-uniform portion cooperating with said valve means whereby said biasing means provides said biasing force and a movement of said valve stem along said axis opens said valve means.

5. A deflator as recited in claim 3, wherein said pneumatic means includes a pneumatic valve partially fixed to said valve stem of said detection line valve and having a second valve seat in a guide for said stem, an axial movement of said stem sealing said pneumatic valve against said second valve seat, said pneumatic valve having chambers on either side of said second valve seat one of which is in communication with a chamber in said exhaust line valve, the other of which is in communication with an air supply.

6. A deflator as recited in claim 5, wherein said biasing means includes an axially non-uniform portion of said stem, a ball engaging said non-uniform portion and a spring biasing said ball against said non-uniform portion.

7. A deflator as recited in claim 1, wherein said detection line valve comprises a barrier member having a surface including said face facing radially away from said axis and being rotatable about said axis, wherein said first exhaust passage faces said face at a position offset from said axis.

8. A deflator as recited in claim 7, further comprising a cam rotating with said barrier member and second pneumatic means for resetting said cam, said cam controlling said first pneumatic means.

9. A deflator as recited in claim 8, wherein said exhaust line valve comprises an exhaust valve guide, a valve rod connected to a valve head facing said second passage and inserted in said valve guide and a piston connected to an end of said valve rod, a first chamber being formed between said valve guide and said piston and being fed gas by said first pneumatic means.

10. A deflator as recited in claim 9, wherein said first pneumatic means includes a pneumatic valve disposed and reciprocatively sliding in a second chamber connecting said first chamber and an air supply, said pneumatic valve including a spring biasing said pneumatic valve against said cam.

11. A deflator as recited in claim 1, further comprising:

a movable plate containing said first and second exhaust passages;

a holding plate for holding said detection line valve and said exhaust line valve and fixed to a connecting member;

guide means in said movable plate for guiding said holding plate to said movable plate;

a hydraulic cylinder for moving said holding palte and having a movable rod;

two joints respectively fixed to said connecting member and to said movable rod and having a junction therebetween with a substantially spherical shape; and a casing for causing said joints to come toward each other for maintaining said junction.

12. A deflator as recited in claim 1, wherein said exhaust valve comprises a valve stem slidable in a valve body attached to a cover on a side of said valve stem opposite said second exhaust passage and further comprising an absorption plate coaxially slidable over a portion of said valve stem and held by an axial nonuniformity in said valve stem from approaching said second exhaust passage, whereby a closing operation of said exhaust line valve throws said absorption plate to said cover.

13. A deflator as recited in claim 12, wherein a mass of said absorption plate approximately equals a mass of said valve stem.

14. A molding apparatus, comprising:

a deflator;

a holding plate for holding a valve of said deflator and fixed to a connecting member;

guide means for guiding said deflator to a plate having an exhaust passage cooperating with said valve;

a hydraulic cylinder having a rod;

two joints respectively fixed to said connecting member and said movable rod and having a junction therebetween with a substantially spherical shape; and a casing for causing said joints to come toward each other for maintaining said junction.

15. A deflator, comprising:

an exhaust passage led from a cavity of a mold;

a valve body having a valve seat and a cover;

a valve disposed in said body having a valve stem with a head seatable with said valve seat and facing said passage and with a rear end adjacent said cover;

an absorption plate slidable along a portion of said valve stem and prevented from approaching said head by an axial non-uniformity in said valve stem, whereby a closing of said valve throws said absorption plate against said cover; and pumping means connected to a side of said valve opposite said exhaust passage.

* * * * *